US011306964B2

(12) United States Patent
Park et al.

(10) Patent No.: US 11,306,964 B2
(45) Date of Patent: Apr. 19, 2022

(54) REFRIGERATOR

(71) Applicant: Samsung Electronics Co., Ltd., Suwon-si (KR)

(72) Inventors: Ji Yong Park, Suwon-si (KR); Yong Man Seo, Suwon-si (KR); Myoung Jin Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/278,809

(22) PCT Filed: Aug. 20, 2019

(86) PCT No.: PCT/KR2019/010526
§ 371 (c)(1),
(2) Date: Mar. 23, 2021

(87) PCT Pub. No.: WO2020/071635
PCT Pub. Date: Apr. 9, 2020

(65) Prior Publication Data

US 2022/0034579 A1 Feb. 3, 2022

(30) Foreign Application Priority Data

Oct. 2, 2018 (KR) ..... 10-2018-0117338

(51) Int. Cl.
*F25D 23/06* (2006.01)
*F25D 25/02* (2006.01)
*A47B 88/975* (2017.01)

(52) U.S. Cl.
CPC ..... *F25D 23/062* (2013.01); *A47B 88/975* (2017.01); *F25D 25/025* (2013.01)

(58) Field of Classification Search
CPC ..... F25D 23/025; A47B 88/975
See application file for complete search history.

(56) References Cited

U.S. PATENT DOCUMENTS 10,451,339 B1 * 10/2019 Wantland ..... F25D 25/025
2009/0133434 A1 5/2009 Uihlein et al.
(Continued)

FOREIGN PATENT DOCUMENTS

JP 5-76341 10/1993
KR 10-2009-0040376 4/2009
(Continued)

OTHER PUBLICATIONS

International Search Report dated Dec. 23, 2020 in International Patent Application No. PCT/KR2019/010526.
(Continued)

*Primary Examiner* — Daniel J Rohrhoff
(74) *Attorney, Agent, or Firm* — Staas & Halsey LLP

(57) ABSTRACT

Disclosed is a refrigerator having an improved structure to improve space utilization of a storage container.
Provided is a refrigerator including a refrigerator including: a main body; a storage chamber provided inside the main body and having an open front surface; a door provided to open and close the open front surface of the storage chamber; and a storage container having a storage space and provided to be withdrawn in the storage chamber, wherein the storage container may include a plurality of guide rails installed to face each other on an inner wall of the storage container; and a divider provided to be movable along the plurality of guide rails to divide the storage space into a plurality of storage spaces.

15 Claims, 23 Drawing Sheets

(56) References Cited

U.S. PATENT DOCUMENTS

| | | | | |
|---|---|---|---|---|
| 2014/0152166 | A1* | 6/2014 | Baum | F25D 25/025 312/404 |
| 2014/0265802 | A1* | 9/2014 | Wilcox | F25D 25/025 312/404 |
| 2015/0069066 | A1* | 3/2015 | Choi | F25D 25/022 220/533 |
| 2018/0116399 | A1* | 5/2018 | Lee | A47B 88/90 |
| 2018/0149415 | A1* | 5/2018 | Jo | F25D 25/025 |
| 2019/0357679 | A1* | 11/2019 | Li | F25D 25/025 |
| 2020/0232701 | A1* | 7/2020 | Li | F25D 23/069 |
| 2021/0341215 | A1* | 11/2021 | Kang | F16C 29/04 |
| 2021/0341218 | A1* | 11/2021 | Wei | A47B 88/975 |

FOREIGN PATENT DOCUMENTS

| | | |
|---|---|---|
| KR | 10-2013-0044959 | 5/2013 |
| KR | 10-2015-0062662 | 6/2015 |
| KR | 10-2016-0114869 | 10/2016 |
| KR | 10-2018-0062122 | 6/2018 |

OTHER PUBLICATIONS

Extended European Search Report dated Sep. 16, 2021 in European Patent Application No. 19869390.5.

* cited by examiner

REFRIGERATOR

CROSS-REFERENCE TO RELATED APPLICATIONS

This application is a U.S. National Stage Application, which claims the benefit under 35 U.S.C. § 371 of PCT International Patent Application No. PCT/KR2019/010526, filed Aug. 20, 2019 which claims the foreign priority benefit under 35 U.S.C. § 119 of Korean Patent Application No. 10-2018-0117338, filed Oct. 2, 2018, the contents of which are incorporated herein by reference.

TECHNICAL FIELD

The disclosure relates to a refrigerator, and more specifically, to a refrigerator having an improved structure to improve the space utilization of a storage container.

BACKGROUND ART

In general, a refrigerator is a device that stores food fresh by having a storage chamber and a cold air supply device supplying cold air to the storage chamber.

The temperature of the storage chamber may be maintained at a temperature within a certain range required to keep food fresh.

The refrigerator may further include a storage container provided to be retractable in the storage chamber to store food. As an example, vegetables, fruits, and the like may be stored in the storage container.

The storage space inside the storage container may be divided into a plurality of storage spaces by a divider. As an example, the divider may be fixedly installed at a specific position of the storage container. In this case, since the divider is not movable, it is impossible to change the size of the plurality of storage spaces divided by the divider in practice. As another example, the divider may be detachably provided in the storage container so that the divider may be disposed at a plurality of predetermined positions. In this case, since the position in which the divider is arranged is limited, there is still a limit to freely using the storage space inside the storage container.

Accordingly, research on various types of dividers to improve the space utilization and storage convenience of the storage container is being actively conducted.

DISCLOSURE

Technical Problem

Therefore, it is an aspect of the disclosure to provide a refrigerator having an improved structure in order to divide a storage space of a storage container into a plurality of storage spaces having various sizes.

Technical Solution

According to an aspect of the disclosure, there is provided a refrigerator including: a main body; a storage chamber provided inside the main body and having an open front surface; a door provided to open and close the open front surface of the storage chamber; and a storage container having a storage space and provided to be withdrawn in the storage chamber, wherein the storage container may include a plurality of guide rails installed to face each other on an inner wall of the storage container; and a divider provided to be movable along the plurality of guide rails to divide the storage space into a plurality of storage spaces, and wherein the divider may include an operating unit; a divider shaft having both ends movable along the plurality of guide rails; a cam gear coupled to the divider shaft and rotating together with the divider shaft; and an interference member configured to move in conjunction with the operating unit to selectively interfere with the cam gear.

The interference member may be coupled to the divider shaft to be movable according to the operation of the operating unit.

The interference member may include teeth provided to engage with the cam gear.

The divider may further include a divider body extending in a longitudinal direction of the divider shaft and having an arm movably coupled to the plurality of guide rails.

The operating unit may be coupled to the divider body to move in the vertical direction of the storage container.

The operating unit may include a pressing portion provided to be exposed to the outside, and a push portion configured to extend from the pressing portion toward a lower side of the storage container and push the interference member to interfere with the cam gear when the operating unit is pressed toward the lower side of the storage container.

The divider may further include an elastic member for moving the interference member away from the cam gear when the operating unit moves upward of the storage container, and the elastic member may be disposed between the divider body and the interference member.

The divider may further include a latch fixedly coupled to the divider body, and the operating unit may include a pressing portion provided to be exposed to the outside and a protrusion formed to protrude from the pressing portion to be coupled to the latch.

The operating unit may include a pressing portion provided to be exposed to the outside; an extension portion formed to extend from the pressing portion toward a lower side of the storage container, and an elastic body disposed between the extension portion and the divider body to be elastically deformable according to the movement of the operating unit.

The plurality of guide rails may include a rack gear, and the divider may further include pinion gears coupled to both ends of the divider shaft to guide the movement of the divider through interaction with the rack gear.

The operating unit may be provided to be slidable in the longitudinal direction of the divider shaft. One end of the interference member may be coupled to the divider shaft, and an other end of the interference member may be coupled to the operating unit. The divider may further include a divider cover disposed outside the divider body to cover the divider body and having an incision cut in the longitudinal direction of the divider shaft.

The operating unit may include an operating unit casing slidably coupled to the divider body, and a plurality of protrusions configured to move integrally with the operating unit casing by being constrained by the incision.

The operating unit may further include an elastic body installed on the divider body to be positioned between the plurality of protrusions adjacent to each other, and provided to be convexly bent in the same direction as the sliding direction of the operating unit by interaction with the plurality of protrusions.

According to another aspect of the disclosure, there is provided a refrigerator including: a main body having a storage chamber, and a storage container having a storage space and provided to be withdrawn in the storage chamber, and wherein the storage container may include a plurality of guide rails installed to face each other on an inner wall of the storage container and a divider provided to be movable along the plurality of guide rails to divide the storage space into a plurality of storage spaces, and wherein the divider may include an operating unit; a divider shaft having both ends movable along the plurality of guide rails; a cam gear coupled to the divider shaft and rotating together with the divider shaft; and an interference member moving in conjunction with the operating unit to selectively interfere with the cam gear.

The interference member may be movable in association with the operation unit.

The interference member may include a teeth provided to engage with the cam gear.

The operation unit may be provided to move in the vertical direction of the storage container, and include a pressing portion provided to be exposed to the outside, and a push portion configured to extend from the pressing unit toward the lower side of the storage container and push the interference member to interfere with the cam gear when the operating unit is pressed toward the lower side of the storage container.

The push portion may include an inclined surface that comes into contact with the interference member to guide the movement of the interference member.

Advantageous Effects

The storage space of the storage container can be easily divided into a plurality of storage spaces having various sizes by using a movable and stoppable divider.

A solid stop state of the divider can be realized through interference between an interference member that moves in conjunction with various types of operation units and a cam gear that is coupled to a divider shaft and rotates integrally with the divider shaft.

DESCRIPTION OF DRAWINGS

These and/or other aspects of the disclosure will become apparent and more readily appreciated from the following description of the embodiments, taken in conjunction with the accompanying drawings of which.

MODES OF THE DISCLOSURE

Hereinafter, embodiments of the disclosure will be described in detail with reference to the accompanying drawings.

The terms "front", "rear", "upper", "lower", "top", and "bottom" as herein used are defined with respect to the drawings, but the terms may not restrict the shape and position of the respective components.

In general, refrigerators can be classified according to the shape of the storage chamber and the door.

There is a Top Mounted Freezer (TMP) type refrigerator in which a storage chamber is divided up and down by a horizontal partition to form a freezing chamber on the upper side and a refrigerating chamber on the lower side, and a Bottom Mounted Freezer (BMF) type refrigerator in which a refrigerating chamber is formed on the upper side and a freezing chamber is formed on the lower side.

In addition, there is an Side By Side (SBS) type refrigerator in which the storage chamber is partitioned left and right by a vertical partition, a freezing chamber is formed on one side, and a refrigerating chamber is formed on the other side, and a French Door Refrigerator (FDR) type refrigerator in which the storage chamber is divided up and down by a horizontal partition wall, a refrigerating chamber is formed on the upper side, and a freezing chamber is formed on the lower side, while the refrigerating chamber on the upper side is opened and closed by a pair of doors.

Hereinafter, an FDR type refrigerator will be described for convenience of explanation.

Figure 1:
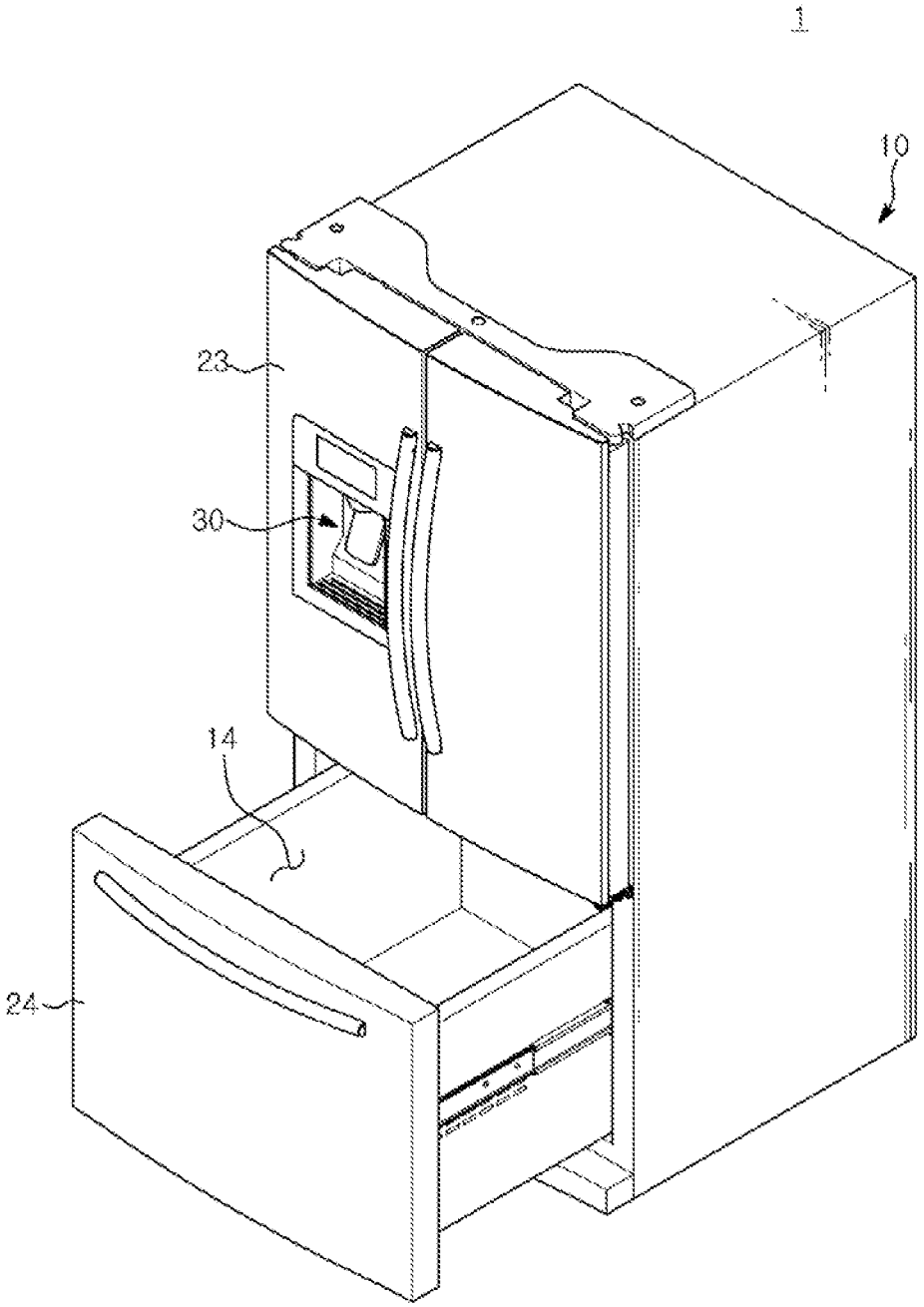
FIG. 1 is a perspective view illustrating a refrigerator according to an embodiment of the disclosure.
Figure 2:
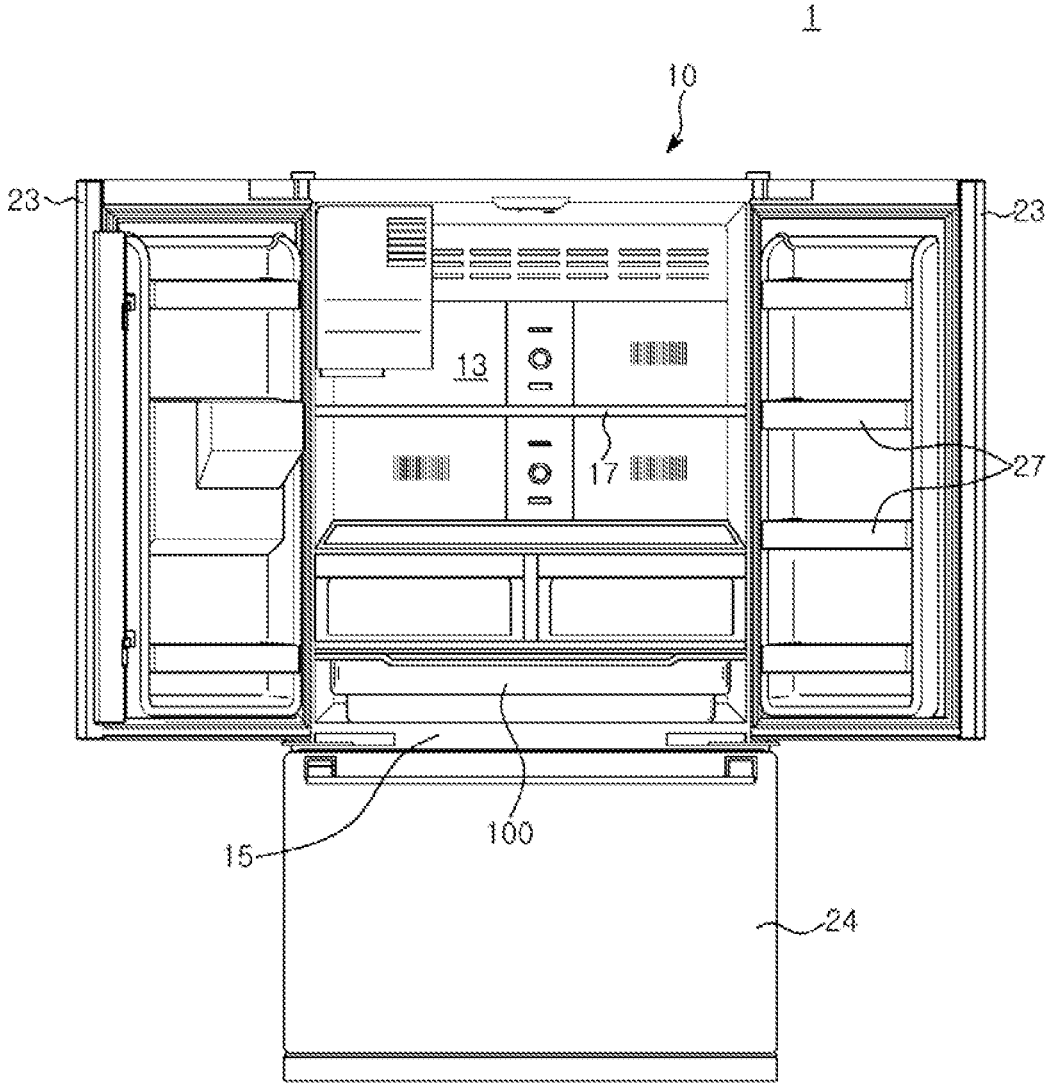
FIG. 2 is a view illustrating a state in which a door of the refrigerator according to an embodiment of the disclosure is opened.

FIG. 1 is a perspective view illustrating a refrigerator according to an embodiment of the disclosure; and FIG. 2 is a view illustrating a state in which a door of the refrigerator according to an embodiment of the disclosure is opened.

As shown in FIGS. 1 and 2, the refrigerator 1 may include a main body 10; a storage chamber 13 and 14 provided inside the main body 10; a cold air supply apparatus (not shown) provided to supply cool air to the storage chambers 13 and 14; and doors 23 and 24 provided to open and close the storage chambers 13 and 14.

The main body 10 may include an inner case 11 (see FIG. 3) configured to form the storage chambers 13 and 14 and an outer case 12 (see FIG. 3) configured to form an exterior.

The cold air supply apparatus (not shown) may configured to include a compressor (not shown), a condenser (not shown), an expansion valve (not shown), an evaporator (not shown), a blower fan (not shown), and a cold air duct (not shown), and an insulating material (not shown) may be disposed between the inner case 11 and the outer case 12 of the main body 10 to prevent leakage of cold air from the storage chambers 13 and 14.

A machine room (not shown) in which a compressor and a condenser for compressing the refrigerant and condensing the compressed refrigerant may be provided at the rear and lower sides of the main body 10.

The storage chambers 13 and 14 may have an open front surface, and the doors 23 and 24 may be provided to open and close the open front surface of the storage chambers 13 and 14.

The storage chambers 13 and 14 may include a refrigerating chamber 13 and a freezing chamber 14. The storage chambers 13 and 14 may include a refrigerating chamber 13 positioned above the horizontal partition wall 15 and a freezing chamber 14 positioned below the horizontal partition wall 15. A shelf 17 on which food can be placed may be provided in the refrigerating chamber 13. In addition, the storage container 100 may be provided in the refrigerating chamber 13 to be withdrawn. Preferably, at least one storage container 100 may be provided in the refrigerating chamber 13 to be able to withdraw. A detailed description of the storage container 100 will be described later.

The doors 23 and 24 may include a refrigerating chamber door 23 for opening and closing the refrigerating chamber 13 and a freezing chamber door 24 for opening and closing the freezing chamber 14. The refrigerating chamber door 23 may be rotatably installed on the main body 10 to open and close the refrigerating chamber 13, and a door guard 27 capable of storing food or the like may be provided on the rear surface of the refrigerating chamber door 23. In addition, a dispenser 30 may be provided on the refrigerating chamber door 23 so that a user may extract water or ice from the outside. The freezing chamber door 24 may be provided to open and close the freezing chamber 14 slidably.

In the above description, the storage container 100 provided to be retractable in the storage chambers 13 and 14 is mainly described, but it is sufficient for the storage container 100 to have a storage space 105, and its shape may be variously changed. As an example, the storage container 100 may be implemented as a drawer type that has a front surface of a door and may be withdrawn from the outside of the refrigerator.

Figure 3:
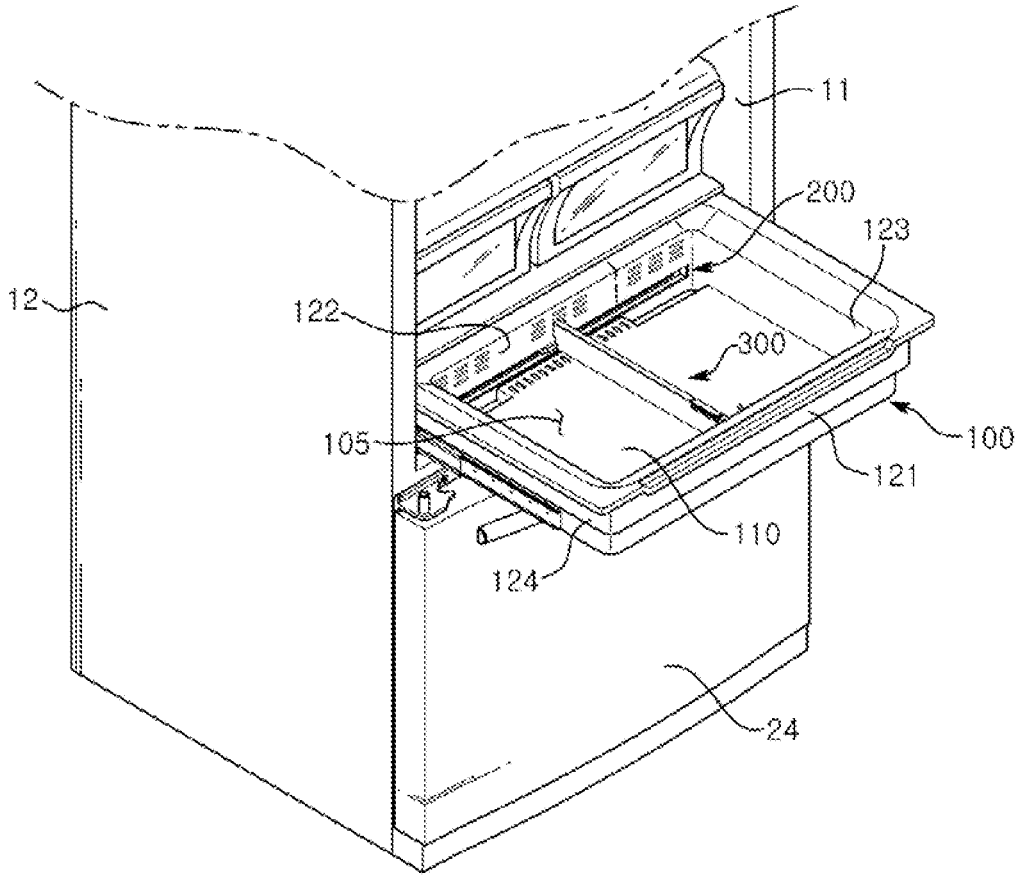
FIG. 3 is a perspective view illustrating a state in which a storage container of a refrigerator according to an embodiment of the disclosure is withdrawn.
Figure 4:
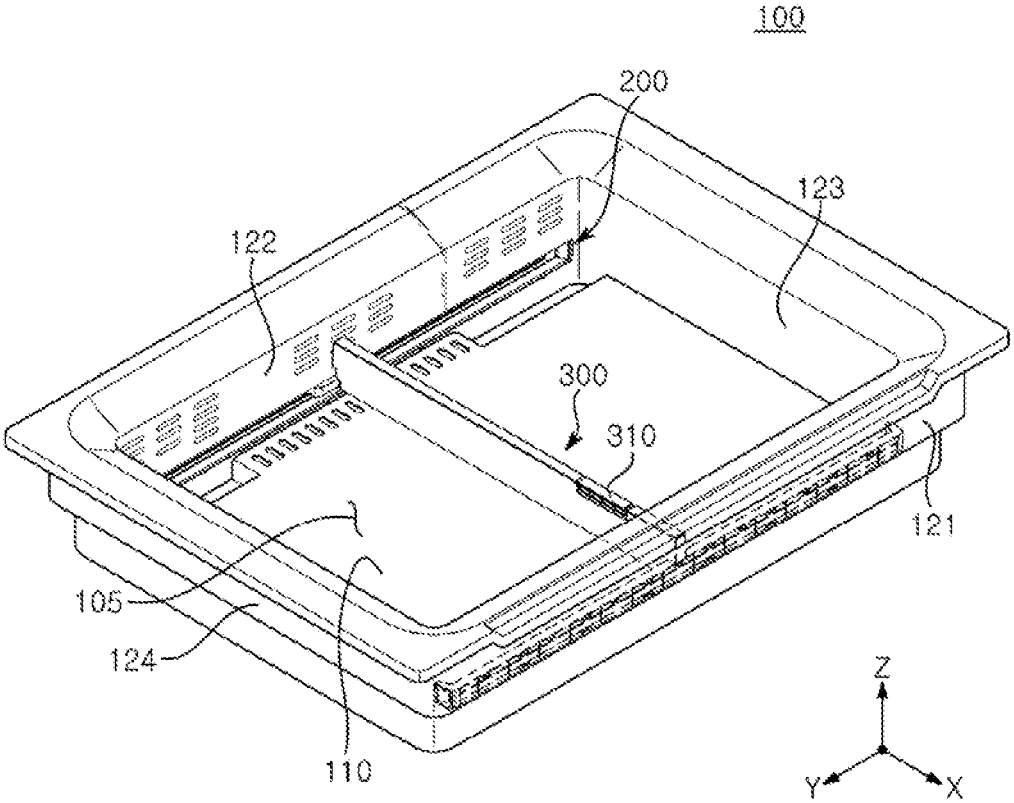
FIG. 4 is a perspective view illustrating a storage container of a refrigerator according to an embodiment of the disclosure.

FIG. 3 is a perspective view illustrating a state in which a storage container of a refrigerator according to an embodiment of the disclosure is withdrawn; and FIG. 4 is a perspective view illustrating a storage container of a refrigerator according to an embodiment of the disclosure. For reference, FIGS. 3 and 4 illustrate a case in which the divider 300 according to the first embodiment is applied.

As shown in FIGS. 3 and 4, the storage container 100 may include a bottom plate 110, walls 121, 122, 123, 124 extending from the edge of the bottom plate 110 toward the upper side of the storage container 100, and a storage space 105 for storing food, etc.

The storage space 105 may be defined by the bottom plate 110 and the walls 121, 122, 123, 124 having a predetermined height in vertical direction Z of the storage container 100. As an example, the storage container 100 may have a box shape having an open top surface.

The walls 121, 122, 123, 124 of the storage container 100 may include a front wall 121 facing the front of the refrigerator 1, a rear wall 122 facing the rear of the refrigerator 1 and facing the front wall 121, a left side wall 124 facing the left side of the refrigerator 1, and a right wall 123 facing the right side of the refrigerator 1 and facing the left wall 124.

The storage container 100 may further include a plurality of guide rails 200 installed on the walls 121, 122, 123, 124 of the storage container 100 so as to face each other, and a divider 300 provided to be movable along the plurality of guide rails 200 to divide the storage space 105 into a plurality of storage spaces.

The plurality of guide rails 200 may be installed to face each other on the inner wall of the storage container 100. Preferably, the plurality of guide rails 200 may be installed on an inner wall of the front wall 121 of the storage container 100 and an inner wall of the rear wall 122 of the storage container 100. The plurality of guide rails 200 may be elongated along left-right direction Y of the storage container 100.

The divider 300 may move in the left-right direction Y of the storage container 100 along the plurality of guide rails 200 to divide the storage space 105 into a left space and a right space.

The installation positions of the plurality of guide rails 200 are not limited to the above example and may be variously changed. As an example, it is also possible to install a plurality of guide rails 200 on the inner wall of the left wall 124 of the storage container 100 and the right wall 123 of the storage container 100. In this case, the plurality of guide rails 200 may be elongated along front-rear direction X of the storage container 100, and the divider 300 may move in the front-rear direction X of the storage container 100 along the plurality of guide rails 200 to divide the storage space 105 into a front space and a rear space.

Hereinafter, for convenience of explanation, a description will be made focusing on case where a plurality of guide rails 200 are installed on the inner wall of the front wall 121 of the storage container 100 and the inner wall of the rear wall 122 of the storage container 100, and the divider 300 moves in the left-right direction Y of the storage container 100. In this case, the front-rear direction X of the storage container 100 and the longitudinal direction of the divider shaft 340 may refer to the same direction.

Figure 5:
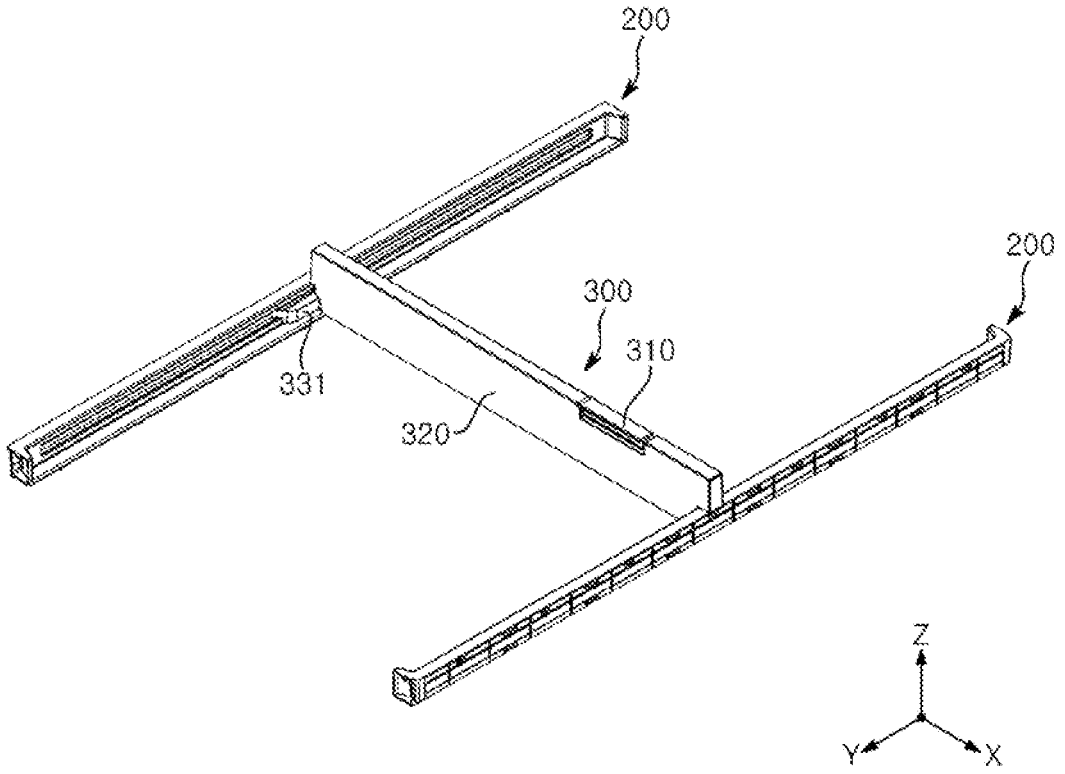
FIG. 5 is a perspective view illustrating a divider and a guide rail according to a first embodiment in a refrigerator according to an embodiment of the disclosure.
Figure 6:
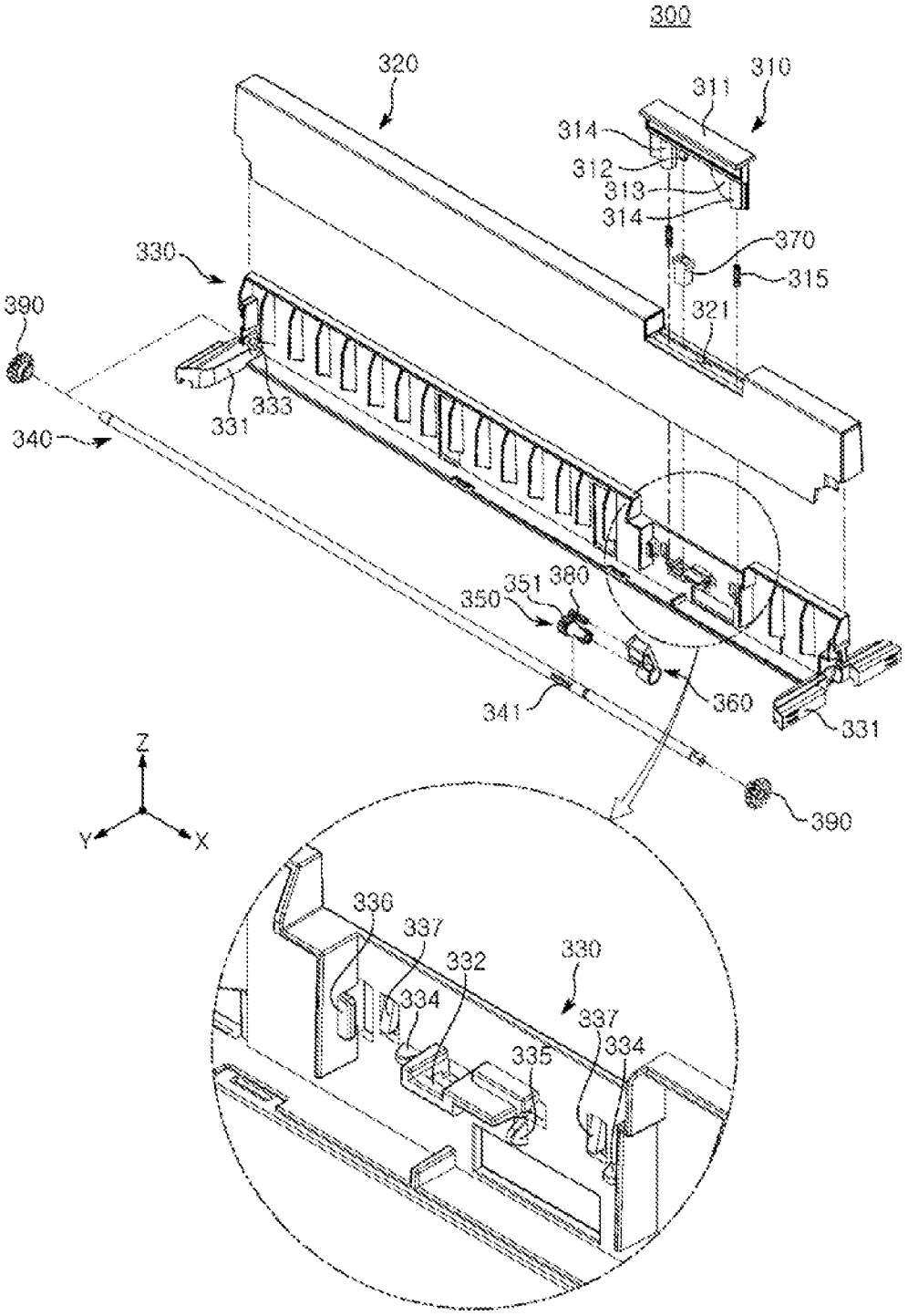
FIG. 6 is an exploded perspective view of a divider according to a first embodiment in a refrigerator according to an embodiment of the disclosure.
Figure 7:
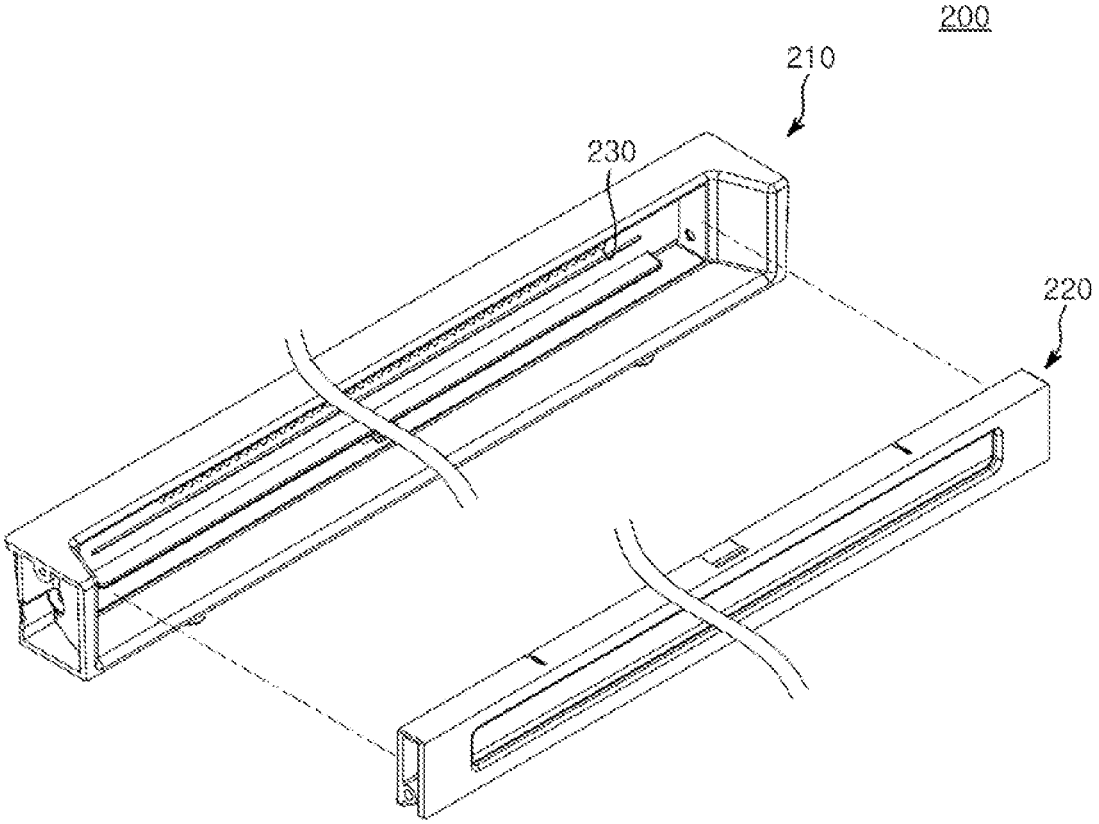
FIG. 7 is an exploded perspective view of a guide rail in a refrigerator according to an embodiment of the disclosure.
Figure 8:
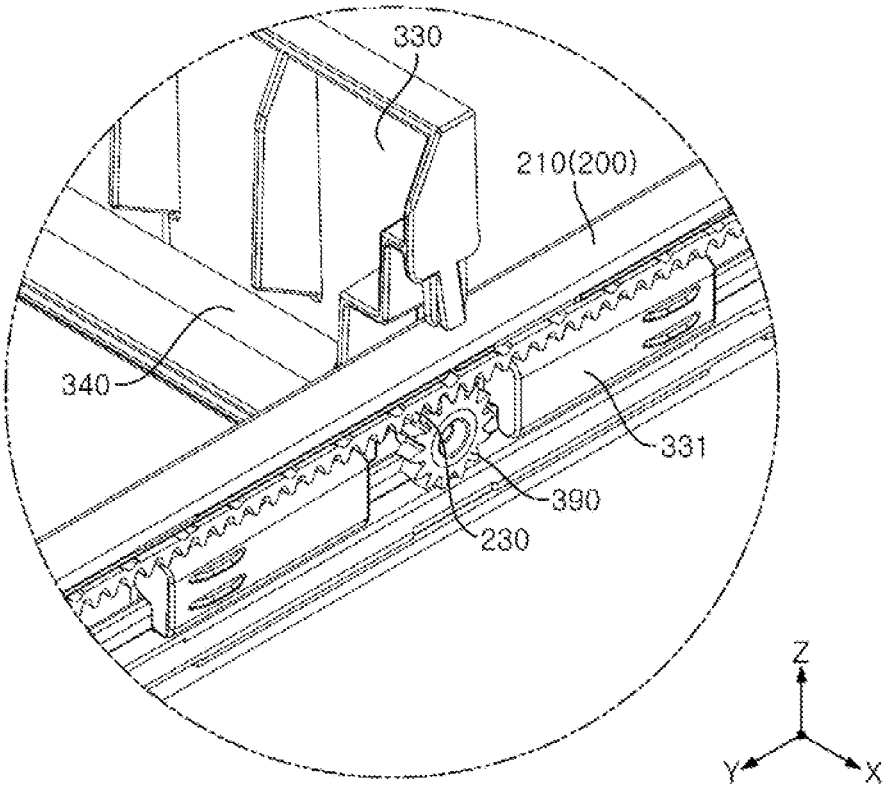
FIG. 8 is a view illustrating a coupling structure between a divider and a guide rail according to a first embodiment in a refrigerator according to an embodiment of the disclosure.

FIG. 5 is a perspective view illustrating a divider and a guide rail according to a first embodiment in a refrigerator according to an embodiment of the disclosure; FIG. 6 is an exploded perspective view of a divider according to a first embodiment in a refrigerator according to an embodiment of the disclosure; FIG. 7 is an exploded perspective view of a guide rail in a refrigerator according to an embodiment of the disclosure; and FIG. 8 is a view illustrating a coupling structure between a divider and a guide rail according to a first embodiment in a refrigerator according to an embodiment of the disclosure.

As shown in FIGS. 5 to 8, the divider 300 includes an operating unit 310 configured to adjust the movement of the divider 300, a divider cover 320 configured to form the exterior of the divider 300, a divider body 330 disposed inside the divider cover 320, and a divider shaft 340 provided to prevent eccentric movement of the divider 300.

The user may limit the movement of the divider 300 or cancel the movement limitation of the divider 300 through operation of the operating unit 310.

The operating unit 310 may be provided to move in the vertical direction Z of the storage container 100. Specifically, the operating unit 310 may be coupled to the divider body 330 so as to move in the vertical direction Z of the storage container 100. As an example, the operating unit 310 may be implemented in a pressurable lever type. Preferably, the operating unit 310 may be provided at a front portion of the divider 300 facing the front of the storage container 100 to facilitate access by the user.

The operating unit 310 may include a pressing portion 311 provided to be exposed to the outside of the divider 300, a protrusion 312 protruding from the pressing portion 311 to interact with the latch 370, and a push portion 313 extending from the pressing portion 311 to move the interference member 360.

When the pressing portion 311 of the operating unit 310 is pressed toward the lower side of the storage container 100, the protrusion 312 of the operating unit 310 is coupled to the latch 370. The operating unit 310 may be maintained in a pressurized state by the combination of the protrusion 312 and the latch 370 of the operating unit 310.

The push portion 313 of the operating unit 310 may include an inclined surface 313*a* (see FIG. 9A) that contacts the interference member 360 and guides the movement of the interference member 360. The inclined surface 313*a* may be formed to be inclined upward with respect to the reference line R extending in the front-rear direction X of the storage container 100 so as to pass through the lower end of the push portion 313.

When the pressing portion 311 of the operating unit 310 is pressed toward the lower side of the storage container 100, the interference member 360 may be guided toward the cam gear 350 by the inclined surface 313*a* of the push portion 313 to interfere with the cam gear 350.

When the interference member 360 and the cam gear 350 interfere, the rotation of the cam gear 350 is restricted, and thus the rotation of the divider shaft 340 integrally moving with the cam gear 350 is also restricted. Accordingly, the movement of the divider 300 may be restricted. That is, the divider 300 may be placed in a stopped state.

The operating unit 310 may extend downward from the pressing portion 311 of the storage container 100, and further include an extension portion 314 having a convex shape toward the outside of the operating unit 310 and an elastic body 315 disposed between the extension portion 314 and the divider body 330 so as to be elastically deformable according to the movement of the operating unit 310.

The elastic body 315 may be disposed in a space defined by the extension portion 314 and the divider body 330 of the operating unit 310. The elastic body 315 may be supported on the elastic body support rib 334 protruding from the divider body 330. The elastic body 315 may include a spring capable of contracting and relaxing in the vertical direction Z of the storage container 100.

When the pressing portion 311 of the operating unit 310 is pressed toward the lower side of the storage container 100, the elastic body 315 may be contracted. In this case, the protrusion 312 of the operating unit 310 may be coupled to the latch 370. When the coupling between the protrusion 312 of the operating unit 310 and the latch 370 is released, the pressing portion 311 of the operating unit 310 moves upward of the storage container 100 by the elastic restoring force of the elastic body 315.

The divider cover 320 may be disposed outside the divider body 330 to cover the divider body 330. The divider cover 320 may include an opening 321. The operating unit 310 may be coupled to the divider body 330 through the opening 321 of the divider cover 320 so that the pressing portion 311 of the operating unit 310 is exposed to the outside.

The divider body 330 may extend in the front-rear direction X of the storage container 100. In other words, the divider body 330 may extend in the longitudinal direction of the divider shaft 340. The divider body 330 may include an arm 331 movably coupled to the plurality of guide rails 200. Specifically, the arm 331 of the divider body 330 may be movably coupled to the inner rail 220 of the plurality of guide rails 200. The divider body 330 may further include a latch holder 332 provided so that the latch 370 is coupled. The divider body 330 may further include a shaft coupling hole 333 through which the divider shaft 340 is coupled through. The divider shaft 340 coupled to the shaft coupling hole 333 of the divider body 330 may be movably coupled to the plurality of guide rails 200 via the pinion gear 390. The divider body 330 may further include an elastic body support rib 334 provided to support the elastic body 315. The divider body 330 may further include an elastic member support rib 335 provided to support the elastic member 380. The divider body 330 may further include an operating unit guide 336 provided to guide the movement of the operating unit 310. The operating unit 310 may move along the vertical direction Z of the storage container 100 with both sides of the operating unit 310 inserted into the operating unit guide 336. The divider body 330 may further include a pressing plate 337 engaged in coupling with the operating unit 310.

When both sides of the operating unit 310 are coupled to the operating unit guide 336, the pressing plate 337 may be provided to press the one surface of the operating unit 310 facing the divider body 330. The pressing plate 337 allows the operating unit 310 to move in the vertical direction Z of the storage container 100, but prevents the operating unit 310 from being completely separated from the divider body 330.

The divider shaft 340 may be elongated in the front-rear direction X of the storage container 100. The divider shaft 340 may include both ends movable along the plurality of guide rails 200. Pinion gears 390 may be coupled to both ends of the divider shaft 340, respectively.

Since the divider 300 moves in the left-right direction Y of the storage container 100 through the interaction between the pinion gears 390 coupled to both ends of the divider shaft 340 and the rack gear 230 of the plurality of guide rails 200, eccentric movement of the divider 300 can be prevented. An uneven portion 341 for restraining the cam gear 350 may be formed on the divider shaft 340.

The divider 300 may further include a cam gear 350 coupled to the divider shaft 340 and integrally rotating with the divider shaft 340; and an interference member 360 provided to selectively interfere with the cam gear 350.

The interference member 360 may be provided to be movable in the longitudinal direction of the divider shaft 340.

That is, the interference member 360 may be movably coupled to the divider shaft 340 so as to selectively interfere with the cam gear 350.

The interference member 360 may move in conjunction with the operating unit 310. That is, the interference member 360 may be coupled to the divider shaft 340 so as to be movable according to the operation of the operating unit 310.

The interference member 360 may include teeth 361 provided to engage with the cam gear 350. That is, when the interference member 360 and the cam gear 350 interfere, the teeth 361 of the interference member 360 and the teeth 351 of the cam gear 350 may engage with each other.

The divider 300 may further include an elastic member 380 disposed between the interference member 360 and the divider body 330 so as to be elastically deformable according to the movement of the interference member 360. The elastic member 380 may be supported on the elastic member support rib 335 protruding from the divider body 330. The elastic member 380 may include a spring capable of contracting and relaxing in the front-rear direction X of the storage container 100.

When the push portion 311 of the operating unit 310 is pressed toward the lower side of the storage container 100, the interference member 360 is pushed by the push portion 313 of the operating unit 310 and interferes with the cam gear 350. At this time, the elastic member 380 may be contracted. When the operating unit 310 moves upward of the storage container 100 as the coupling between the protrusion 312 and the latch 370 of the operating unit 310 is released, the interference member 360 may be moved to be spaced apart from the cam gear 350 by the elastic restoring force of the elastic member 380.

The divider 300 may further include pinion gears 390 coupled to both ends of the divider shaft 340 to guide the movement of the divider 300 through interaction with the rack gear 230. The pinion gears 390 may rotate integrally with the divider shaft 340.

The divider 300 may further include a latch 370 fixedly coupled to the divider body 330 so that the protrusion 312 of the operating unit 310 is coupled. The latch 370 may be fixedly coupled to the latch holder 332 of the divider body 330.

As shown in FIG. 7, the plurality of guide rails 200 may include an outer rail 210 installed on the inner wall of the storage container 100, an inner rail 220 disposed inside the outer rail 210, and a rack gear 230 installed on the outer rail 210. The rack gear 230 may be integrally formed with the outer rail 210 on the inner wall of the outer rail 210 so as to face the inner rail 220. Preferably, the rack gear 230 may be formed on the upper inner wall of the outer rail 210.

The arm 331 of the divider body 330 may be movably coupled to the inner rail 220, and the pinion gears 390 coupled to both ends of the divider shaft 340 may rotate while being engaged with the rack gear 230 of the outer rail 210.

Figure 9A:
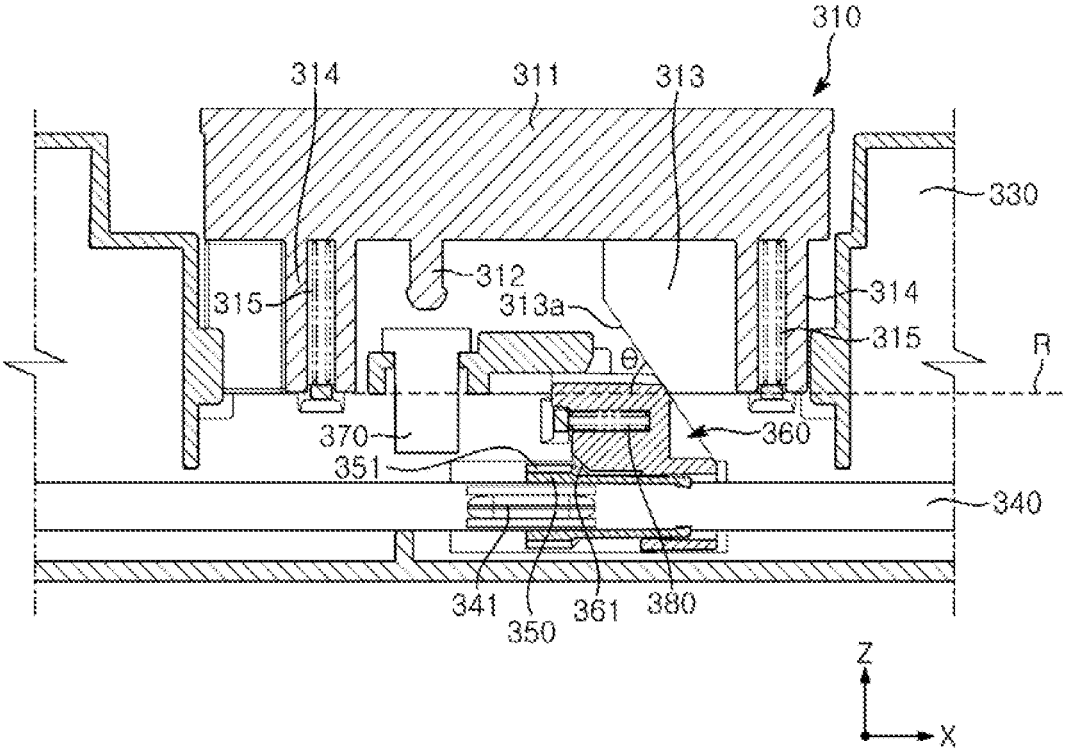
FIGS. 9A to 9C are views illustrating a process of fixing a divider according to a first embodiment in a refrigerator according to an embodiment of the disclosure.
Figure 9B:
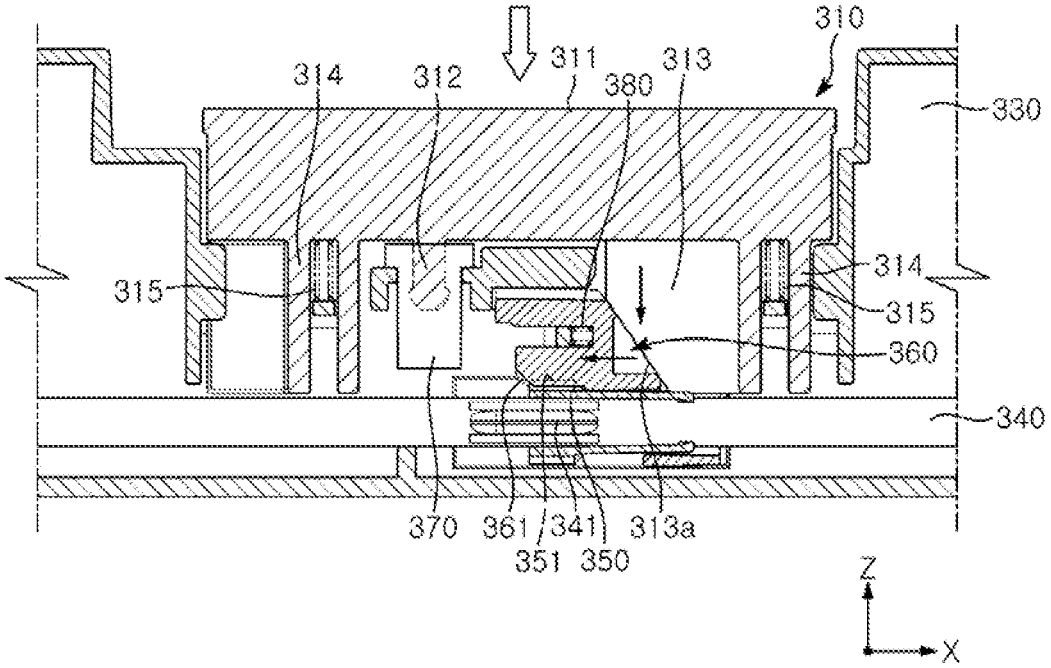
Figure 9C:
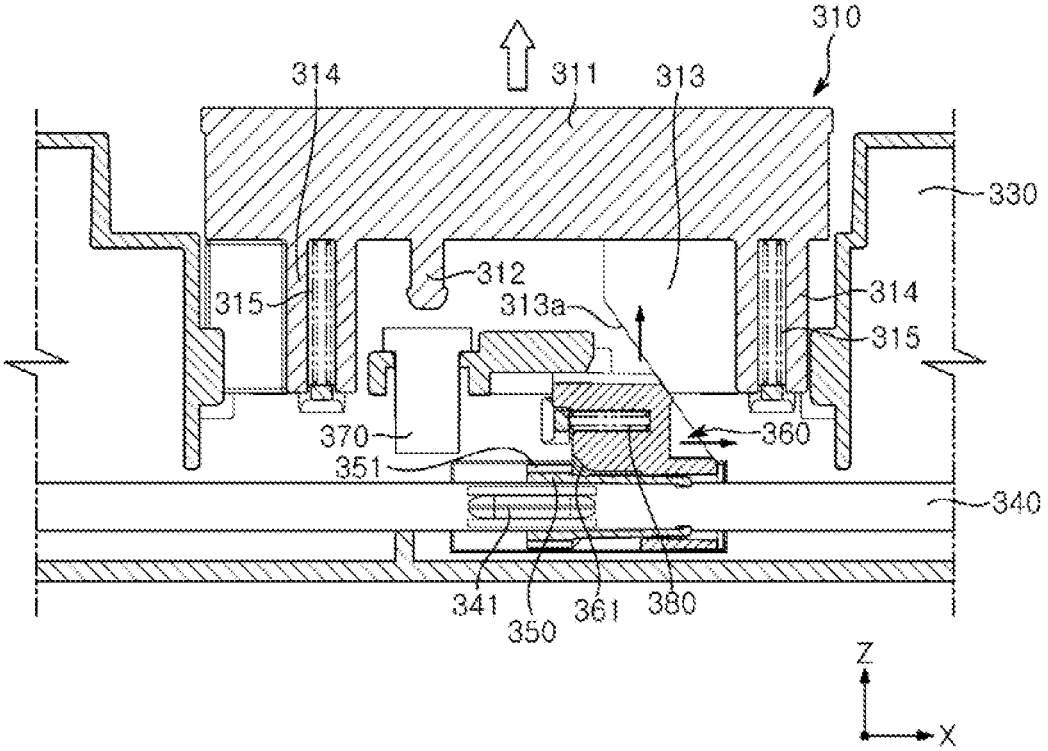
Figure 10:
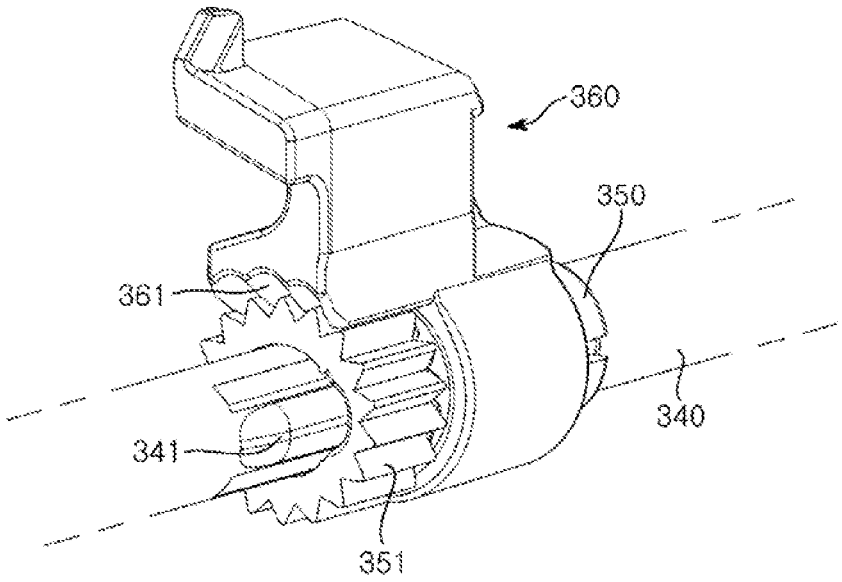
FIG. 10 is an enlarged view of a part of FIG. 9C.

FIGS. 9A to 9C are views illustrating a process of fixing a divider according to a first embodiment in a refrigerator according to an embodiment of the disclosure; and FIG. 10 is an enlarged view of a part of FIG. 9C.

FIG. 9A shows the divider 300 in a movable state. As shown in FIG. 9A, Since the cam gear 350 and the interference member 360 do not interfere with each other, when the operating unit 310 is not pressed, the cam gear 350 and the interference member 360 do not interfere with each other, so the divider shaft 340 can rotate freely. At this time, the pinion gears 390 coupled to both ends of the divider shaft 340 may rotate by engaging with the rack gears 230 of the plurality of guide rails 200, and the arm 331 of the divider body 330 may move in the left-right direction Y of the storage container 100 along the plurality of guide rails 200.

FIG. 9B shows the divider 300 in a stopped state. As shown in FIGS. 9B and 10, when the operating unit 310 is pressed toward the lower side of the storage container 100, the protrusion 312 of the operating unit 310 is coupled to the latch 370 to maintain the pressurized state of the operating unit 310. The interference member 360 is pushed by the push unit 313 of the operating unit 310 and moves toward the cam gear 350, and eventually interferes with the cam gear 350.

When the interference member 360 interferes with the cam gear 350, since the teeth 361 of the interference member 360 and the teeth 351 of the cam gear 350 may engage with each other, and the rotation of the cam gear 350 is limited, the rotation of the divider shaft 340 is also limited. Accordingly, the movement of the divider 300 is limited.

FIG. 9C shows the divider 300 in which the stop state is released. As shown in FIG. 9C, when the operating unit 310 is pressed once more toward the bottom of the storage container 100, as the coupling between the protrusion 312 and the latch 370 of the operating unit 310 is released, the interference member 360 is moved to be spaced apart from the cam gear 350 by the elastic restoring force of the elastic member 380 when the operating unit 310 moves upward of the storage container 100. The divider shaft 340 may freely rotate as the interference between the cam gear 350 and the interference member 360 is released. Accordingly, the divider 300 may move in the left-right direction Y of the storage container 100 along the plurality of guide rails 200.

Figure 11:
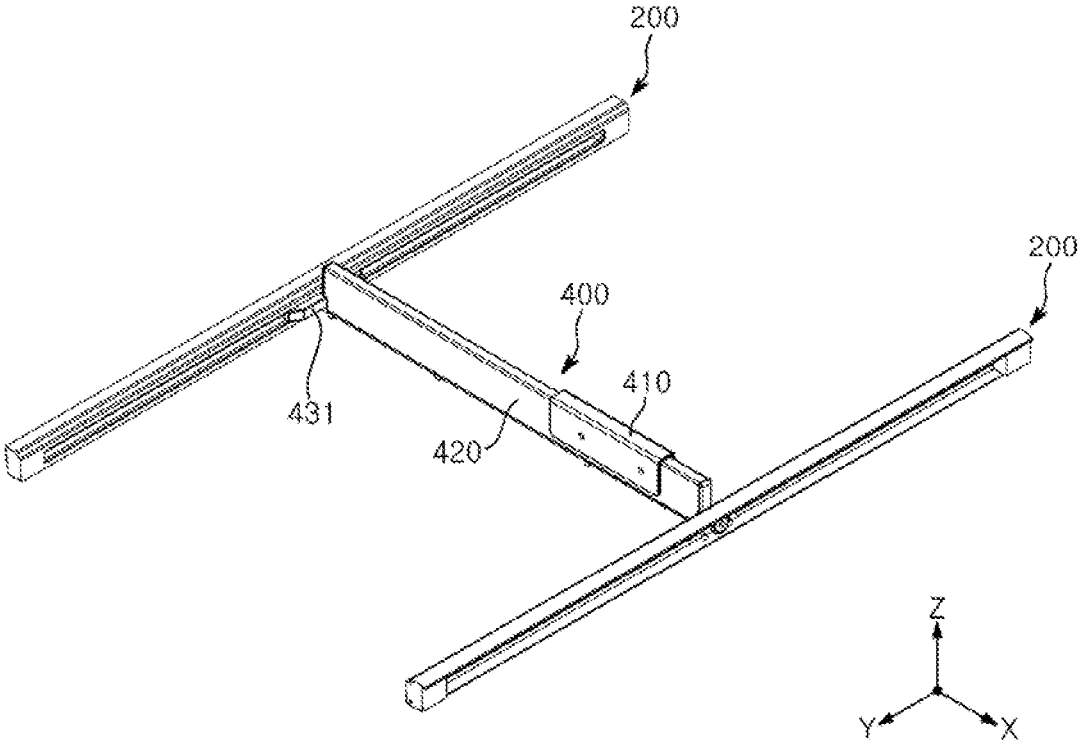
FIG. 11 is a perspective view illustrating a divider and a guide rail according to a second embodiment in a refrigerator according to an embodiment of the disclosure.
Figure 12:
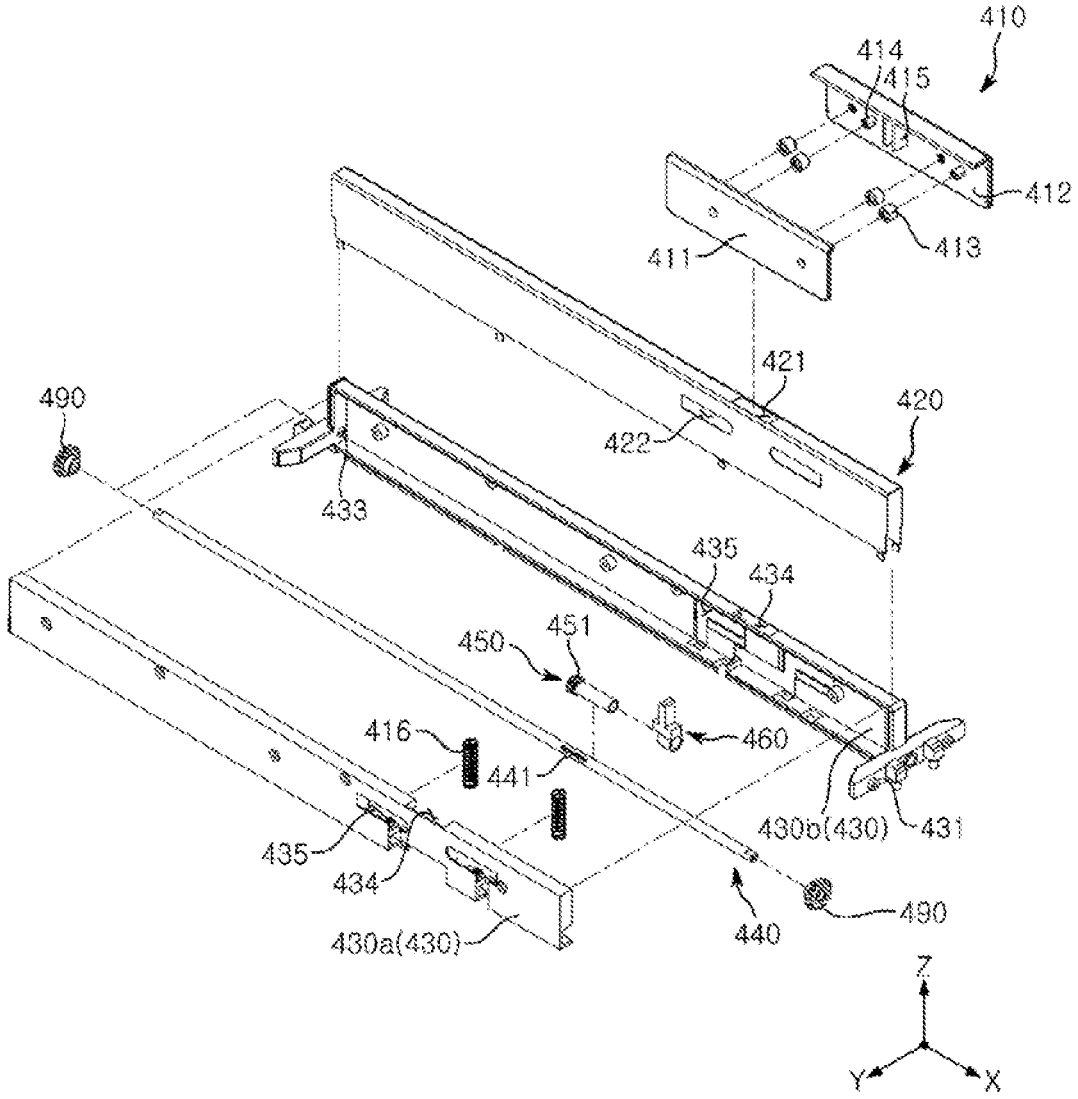
FIG. 12 is an exploded perspective view of a divider according to a second embodiment in a refrigerator according to an embodiment of the disclosure.

FIG. 11 is a perspective view illustrating a divider and a guide rail according to a second embodiment in a refrigerator according to an embodiment of the disclosure; and FIG. 12 is an exploded perspective view of a divider according to a second embodiment in a refrigerator according to an embodiment of the disclosure.

Hereinafter, descriptions overlapping with the description of the divider 300 according to the first embodiment will be omitted. In addition, descriptions of the plurality of guide rails 200 are omitted since they overlap with those described in FIGS. 1 to 10.

As shown in FIGS. 11 and 12, the divider 400 may include an operating unit 410 configured to control the movement of the divider 400, a divider cover 420 forming the exterior of the divider 400, a divider body 430 disposed inside the divider cover 420, and a divider shaft 440 provided to prevent eccentric movement of the divider 400.

The user may limit the movement of the divider 400 or release the movement limitation of the divider 400 through operation of the operating unit 410.

The operating unit 410 may be provided to be slidable in the longitudinal direction of the divider shaft 440. In other words, the operating unit 410 may be provided to be slidable in the front-rear direction X of the storage container 100. The operating unit 410 may be coupled to the outside of the divider cover 420 so as to be slidable. As an example, the operating unit 410 may be implemented as a slidable slider type. Preferably, the operating unit 410 may be provided at a front portion of the divider 400 facing the front of the storage container 100 to facilitate access by the user.

The operating unit 410 may include operating unit casings 411 and 412 slidably coupled to the divider cover 420. The operating unit casings 411 and 412 may include a first operating casing 411 and a second operating casing 412 coupled to the first operating casing 411.

The operating unit 410 may further include a plurality of protrusions 413 fixed to the operating unit casings 411 and 412 so as to move integrally with the operating unit casings 411 and 412. The plurality of protrusions 413 may have a column shape having a hollow. However, the shape of the plurality of protrusions 413 is not limited to the above example and may be variously modified. A plurality of guide bosses 414 to which a plurality of protrusions 413 may be coupled may be formed on an inner wall of any one of the first operating casing 411 and the second operating casing 412. Some of the plurality of protrusions 413 may be coupled to a plurality of guide bosses formed on the inner wall of the first operating casing 411, and the remaining of the plurality of protrusions 413 may be coupled to a plurality of guide bosses formed on the inner wall of the second operating casing 412. The first operating casing 411 and the second operating casing 412 may be coupled to each other by a fixing member (not shown) fastened to the plurality of guide bosses 414. The fixing member may include a screw.

The plurality of protrusions 413 may be inserted into the side incision 422 of the divider cover 420 when the operating unit 410 is coupled to the divider cover 420. The plurality of protrusions 413 inserted into the side incision 422 of the divider cover 420 are constrained by the side incision 422 of the divider cover 420 and may move integrally with the operating unit casings 411 and 412. The slidable range of the operating unit 410 may be defined as a range in which the plurality of protrusions 413 of the operating unit 410 may move without interference with the side incision 422 of the divider cover 420.

The operating unit 410 may further include an interference member coupling 415. The interference member coupling 415 may be formed inside the operating unit 410 so that the interference member 460 may be coupled. As an example, the interference member coupling 415 may extend from an upper inner wall of the operating unit 410 toward the lower side of the storage container 100. When the operating unit 410 is coupled to the divider cover 420, the interference member coupling portion 415 may be inserted into the upper incision 421 of the divider cover 420 and coupled to the interference member 460 disposed inside the divider 400.

The operating unit 410 may further include an elastic body 416 installed on the divider body 430 so as to be elastically deformable according to manipulation of the operating unit 410. The elastic body 416 may include a spring having a predetermined length in the vertical direction Z of the storage container 100. The elastic body 416 may be installed on the divider body 430 so as to be positioned between a plurality of protrusions 413 adjacent to each other when the operating unit 410 is coupled to the divider cover 420. The elastic body 416 may be provided to be convexly bent in the same direction as the sliding direction of the operating unit 410 by interaction with the plurality of protrusions 413.

The divider cover 420 may be disposed outside the divider body 430 to cover the divider body 430. The divider cover 420 may include an upper incision 421 and a side incision 422. The operating unit 410 may be slidably coupled to the divider cover 420 to cover the upper incision 421 and the side incision 422 of the divider cover 420. The interference member coupling 415 of the operating unit 410 may be inserted into the upper incision 421 of the divider cover 420 and coupled to the interference member 460. The plurality of protrusions 413 of the operating unit 410 may be constrained by the side incision 422 of the divider cover 420 to move integrally with the operating unit casings 411 and 412. The side incision 422 of the divider cover 420 may have a shape elongated in the longitudinal direction of the divider shaft 440. That is, the side incision 422 of the divider cover 420 may have a shape elongated along the front-rear direction X of the storage container 100. The movement of the operating unit 410 may be limited by interference between the plurality of protrusions 413 and the side incision 422.

As an example, the side incision 422 has a front end 422*a* (see FIG. 13A) facing the front of the storage container 100 and a rear end 422*b* (see FIG. 13A) facing the rear of the storage container 100, and a plurality of protrusions 413 that are constrained to the side incision 422 and move may include a front protrusion 413*a* (see FIG. 13A) facing the front of the storage container 100, and a rear protrusion 413*b* (see FIG. 13A) facing the rear of the storage container 100. The operating unit 410 is slidable toward the front of the storage container 100 until the front protrusion 413*a* interferes with the front end 422*a* of the side incision 422. At this time, the elastic body 416 positioned between the front protrusion 413*a* and the rear protrusion 413*b* may be bent to surround the rear protrusion 413*b*. In other words, the elastic body 416 positioned between the front protrusion 413*a* and the rear protrusion 413*b* may be convexly bent toward the front of the storage container 100. In addition, the operating unit 410 is slidable toward the rear of the storage container 100 until the rear protrusion 413*b* interferes with the rear end portion 422*b* of the side incision 422. At this time, the elastic body 416 positioned between the front protrusion 413*a* and the rear protrusion 413*b* may be bent to surround the front protrusion 413*a*. In other words, the elastic body 416 positioned between the front protrusion 413*a* and the rear protrusion 413*b* may be convexly bent toward the rear of the storage container 100.

The divider body 430 may extend in the front-rear direction X of the storage container 100. In other words, the divider body 430 may extend in the longitudinal direction of the divider shaft 440. The divider body 430 may include an arm 431 movably coupled to the plurality of guide rails 200. The divider body 430 may further include a shaft coupling hole 433 through which the divider shaft 440 is coupled through. The divider body 430 may include an upper corresponding incision 434 corresponding to the upper incision 421 of the divider cover 420 and a side corresponding incision 435 corresponding to the side incision 422 of the divider cover 420. The divider body 430 may be implemented by combining the first divider body 430*a* and the second divider body 430*b*.

The divider shaft 440 may extend long in the front-rear direction X of the storage container 100. Pinion gears 490 may be coupled to both ends of the divider shaft 440, respectively. Since the divider 400 moves in the left-right direction Y of the storage container 100 through the interaction between the pinion gears 490 coupled to both ends of the divider shaft 440 and the rack gears 230 of the plurality of guide rails 200, eccentric movement of the divider 400 may be prevented. The divider shaft 440 may have an uneven portion 441 for restraining the cam gear 450. The divider shaft 440 may be located inside the divider body 430, that is, between the first divider body 430*a* and the second divider body 430*b*. The elastic body 416 may also be located inside the divider body 430, that is, between the first divider body 430*a* and the second divider body 430*b*.

The divider 400 may further include a cam gear 450 coupled to the divider shaft 440 and integrally rotating with the divider shaft 440, and an interference member 460 provided to selectively interfere with the cam gear 450.

The interference member 460 may be provided to be movable in the longitudinal direction of the divider shaft 440. That is, the interference member 460 may be movably coupled to the divider shaft 440 so as to selectively interfere with the cam gear 450.

The interference member 460 may move in conjunction with the operating unit 410. That is, the interference member 460 may be coupled to the divider shaft 440 and the operating unit 410 so as to be movable according to the operation of the operating unit 410. Specifically, one end of the interference member 460 may be coupled to the divider shaft 440, and the other end of the interference member 460 may be coupled to the interference member coupling 415 of the operating unit 410.

The interference member 460 may include teeth 461 provided to engage with the cam gear 450. That is, when the interference member 460 and the cam gear 450 interfere, the teeth 461 of the interference member 460 and the teeth 451 of the cam gear 450 may engage with each other.

The divider 400 may further include pinion gears 490 coupled to both ends of the divider shaft 440 to guide the movement of the divider 400 through interaction with the rack gear 230. The pinion gears 490 may rotate integrally with the divider shaft 440.

Figure 13A:
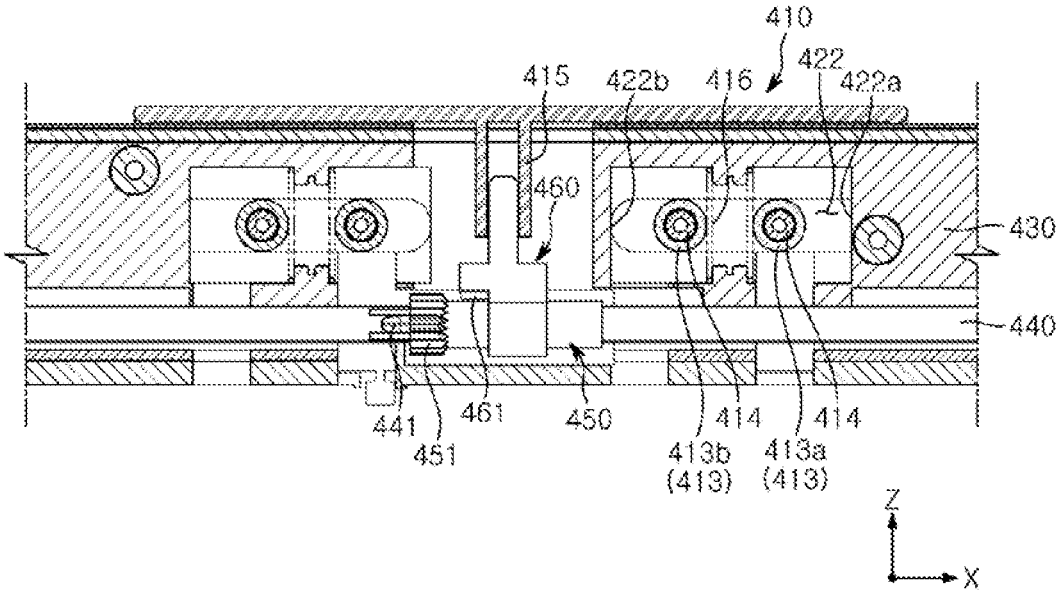
FIGS. 13A to 13C are views illustrating a process of fixing a divider according to a second embodiment in a refrigerator according to an embodiment of the disclosure.
Figure 13B:
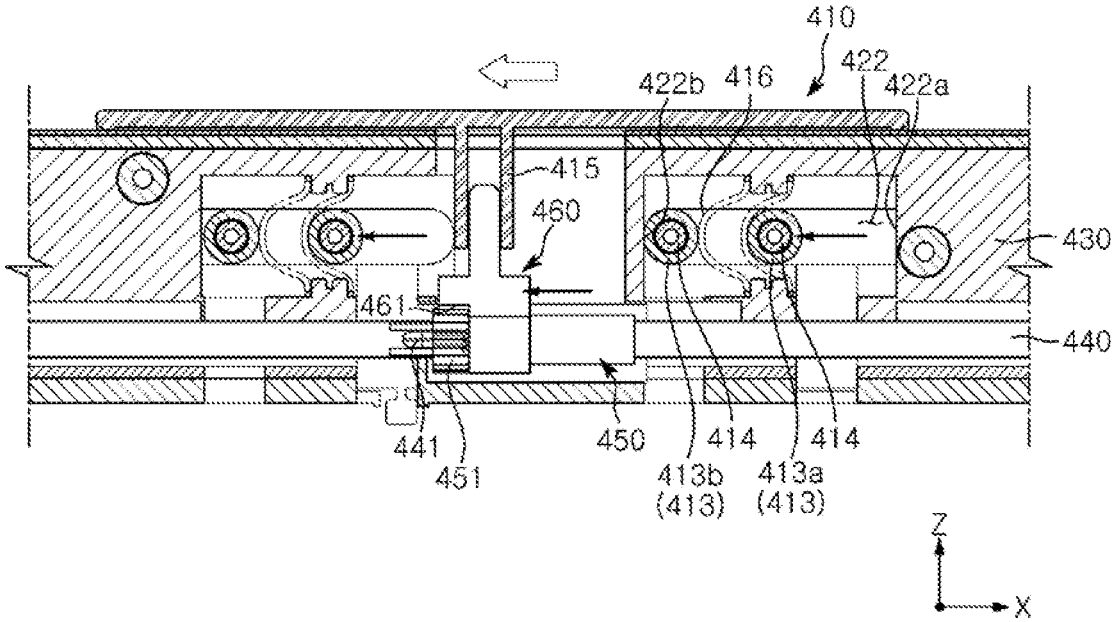
Figure 13C:
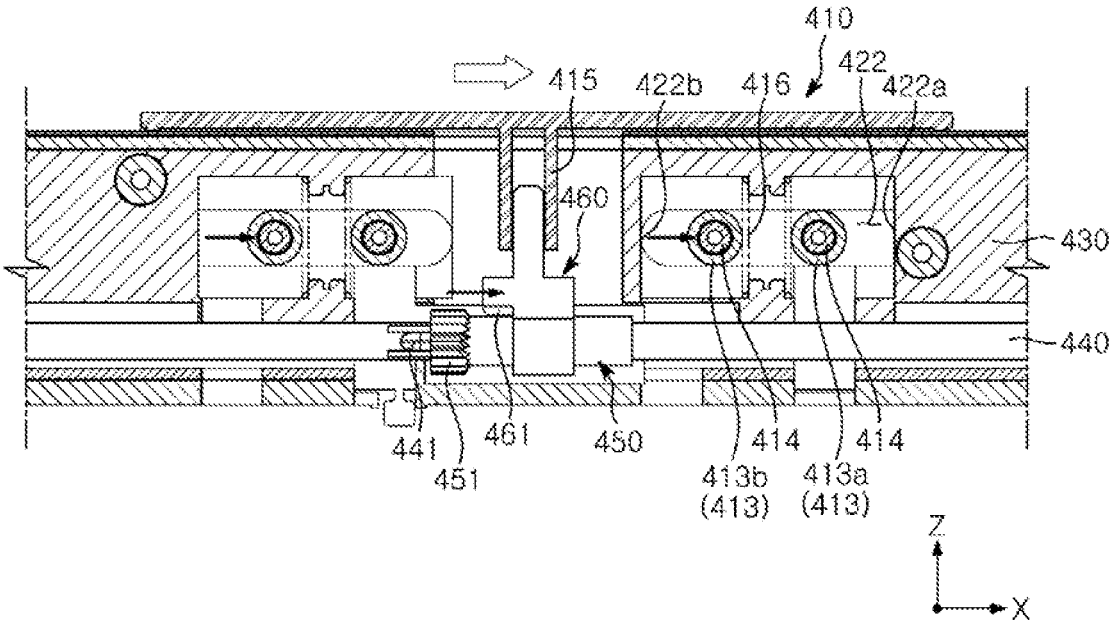

FIGS. 13A to 13C are views illustrating a process of fixing a divider according to a second embodiment in a refrigerator according to an embodiment of the disclosure.

FIG. 13A shows the divider 400 in a movable state. As shown in FIG. 13A, when an external force is not applied to the operating unit 410, the cam gear 450 and the interference member 460 do not interfere with each other, so the divider shaft 440 can rotate freely. At this time, the pinion gears 490 coupled to both ends of the divider shaft 440 may rotate by engaging with the rack gear 230 of the plurality of guide rails 200, and the arm 431 of the divider body 430 may move in the left-right direction Y of the storage container 100 along the plurality of guide rails 200.

FIG. 13B shows the divider 400 in a stopped state. As shown in FIG. 13B, when the operating unit 410 is slid toward the rear of the storage container 100, the interference member 460 connected to the operating unit 410 moves toward the rear of the storage container 100 integrally with the operating unit 410, and eventually interferes with the cam gear 450. In this case, the elastic body 416 may be convexly bent in the same direction as the sliding direction of the operating unit 410. When the interference member 460 interferes with the cam gear 450, since the teeth 461 of the interference member 460 and the teeth 451 of the cam gear 450 may engage with each other, and the rotation of the cam gear 450 is limited, the rotation of the divider shaft 440 is also limited. Accordingly, the movement of the divider 400 is limited.

FIG. 13C shows the divider 400 in which the stop state is released. As shown in FIG. 13C, when the operating unit 410 is slid toward the front of the storage container 100, the interference member 460 connected to the operating unit 410 moves toward the front of the storage container 100 integrally with the operating unit 410, and is eventually separated from the cam gear 450. The elastic body 416 may be restored to a state before an external force is applied to the operating unit 410 by the elastic restoring force. The divider shaft 440 may freely rotate as the interference between the cam gear 450 and the interference member 460 is released. Accordingly, the divider 400 may move in the left-right direction Y of the storage container 100 along the plurality of guide rails 200.

When the operating unit 410 is further slid toward the front of the storage container 100, the elastic body 416 may be convexly bent in the same direction as the sliding direction of the operating unit 410, and the interference member 460 connected to the operating unit 410 may be further spaced apart from the cam gear 450.

Figure 14:
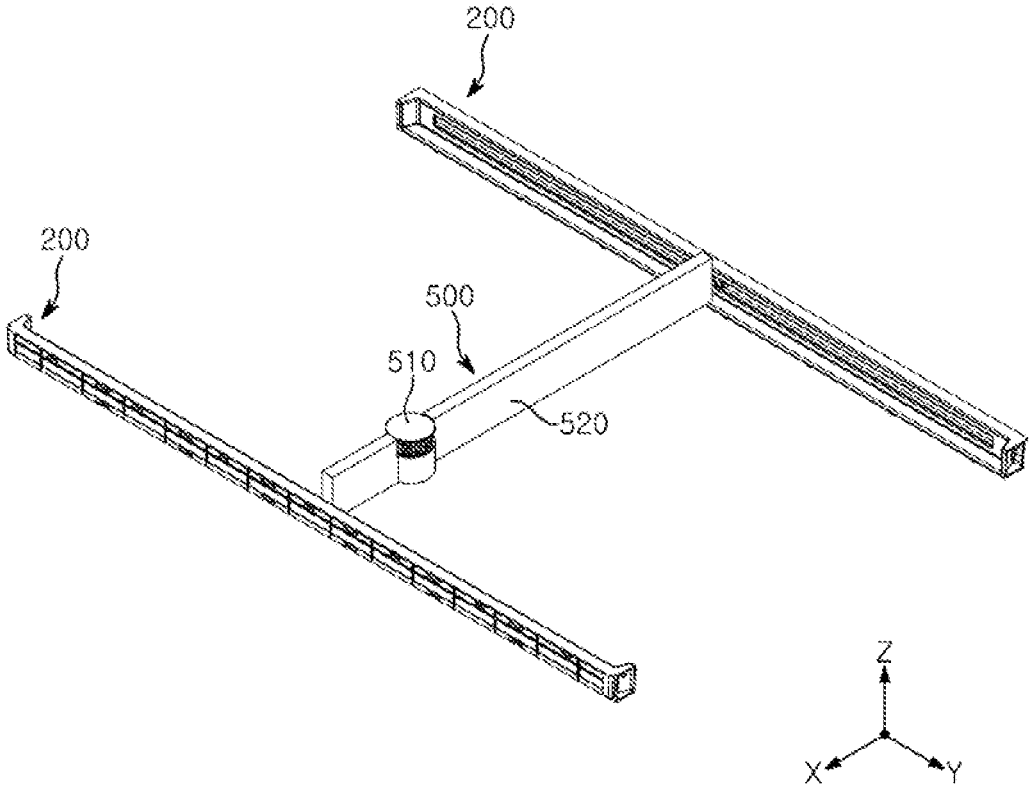
FIG. 14 is a perspective view illustrating a divider and a guide rail according to a third embodiment in a refrigerator according to an embodiment of the disclosure.
Figure 15:
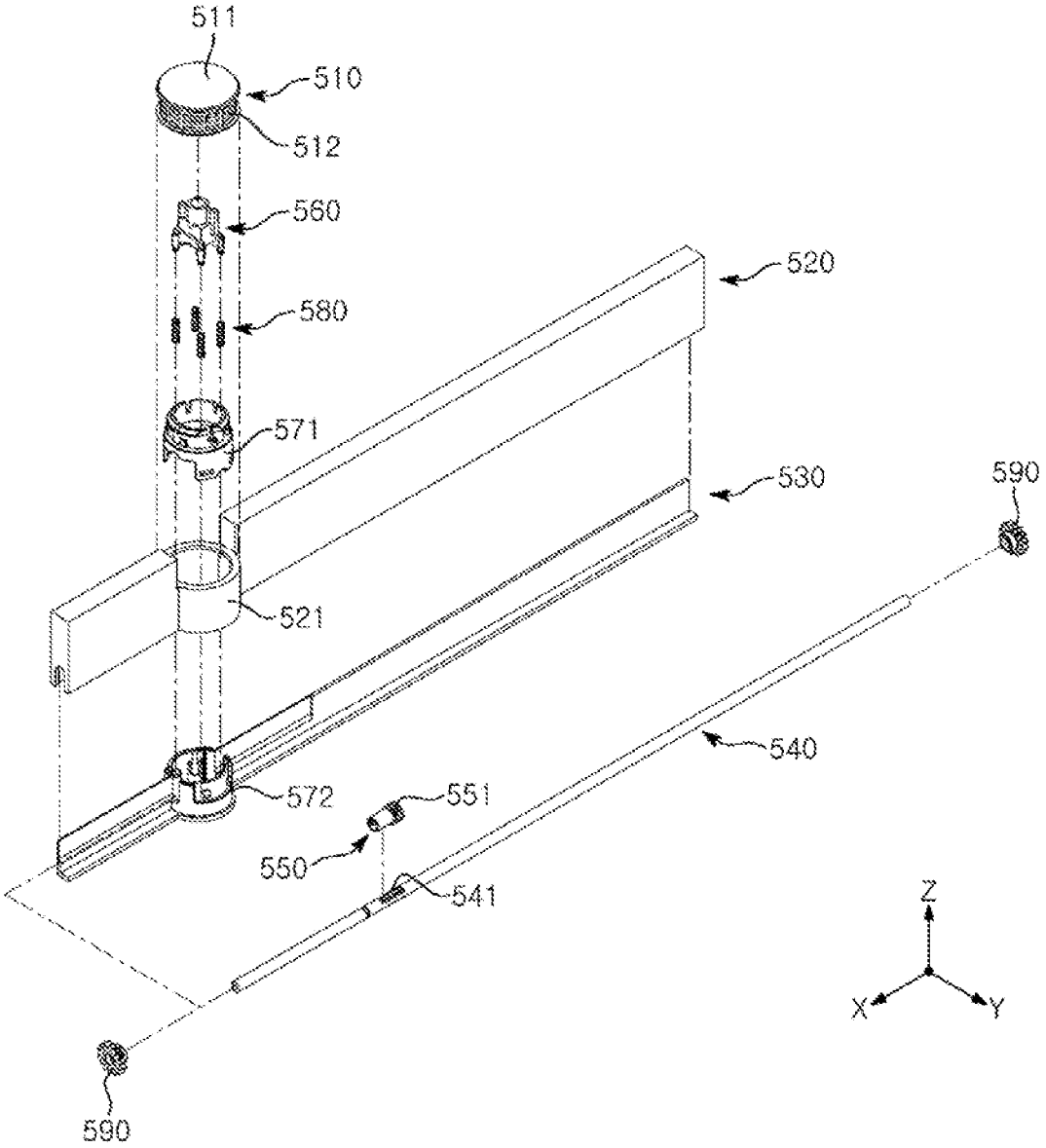
FIG. 15 is an exploded perspective view of a divider according to a third embodiment in a refrigerator according to an embodiment of the disclosure.
Figure 16:
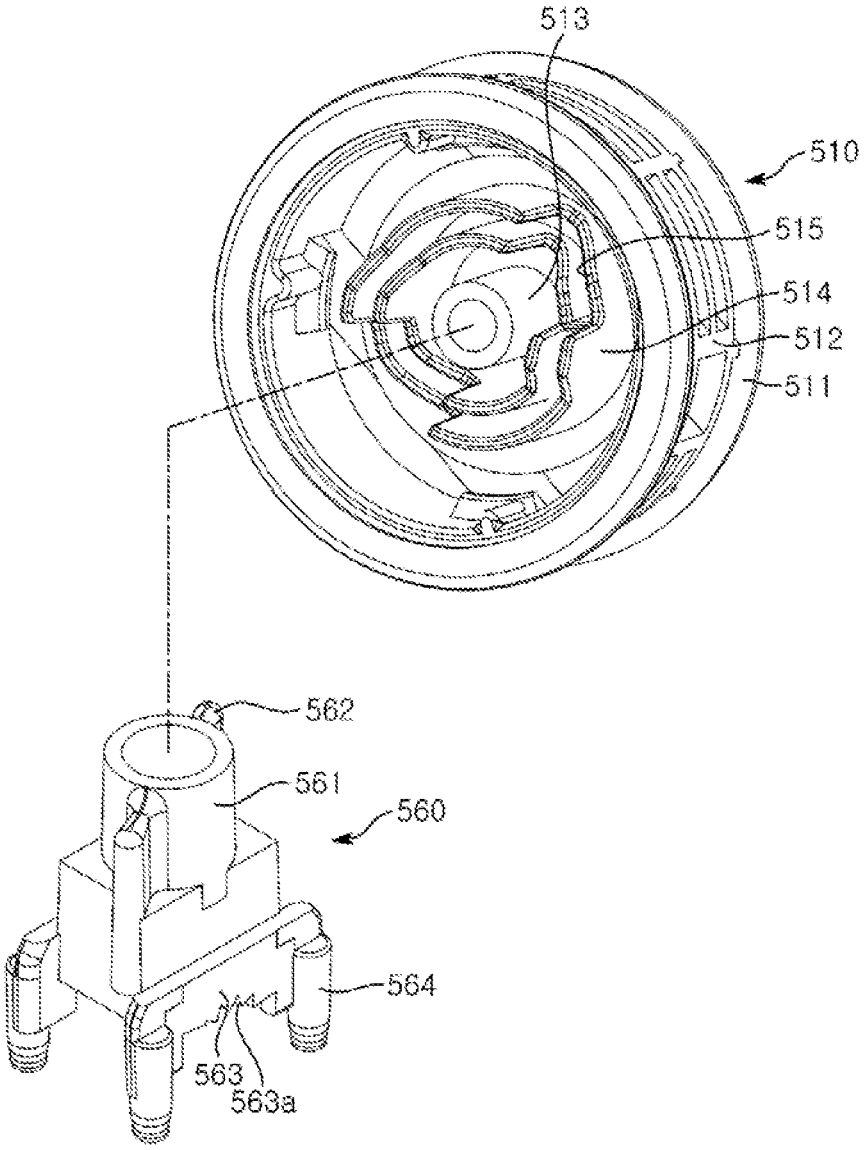
FIG. 16 is an enlarged view illustrating an operating unit and an interference member of a divider according to a third embodiment in a refrigerator according to an embodiment of the disclosure.

FIG. 14 is a perspective view illustrating a divider and a guide rail according to a third embodiment in a refrigerator according to an embodiment of the disclosure; FIG. 15 is an exploded perspective view of a divider according to a third embodiment in a refrigerator according to an embodiment of the disclosure; and FIG. 16 is an enlarged view illustrating an operating unit and an interference member of a divider according to a third embodiment in a refrigerator according to an embodiment of the disclosure. Hereinafter, descriptions overlapping with the description of the divider 300 according to the first embodiment will be omitted. In addition, descriptions of the plurality of guide rails 200 are omitted since they overlap with those described in FIGS. 1 to 10.

As shown in FIGS. 14 to 16, the divider 500 may include an operating unit 510 configured to adjust the movement of the divider 500, a divider cover 520 forming the exterior of the divider 500, a divider body 530 disposed inside the divider cover 520, and a divider shaft 540 provided to prevent eccentric movement of the divider 500.

The user may limit the movement of the divider 500 or release the movement limitation of the divider 500 through operating of the operating unit 510. The operating unit 510 may be exposed to the outside to facilitate access by a user. In addition, the operating unit 510 may be provided at a front portion of the divider 500 facing the front of the storage container 100 to facilitate access by the user.

The operating unit 510 may be provided to be rotatable. The operating unit 510 may be rotatably coupled to the interference member 560. As an example, the operating unit 510 may be implemented in a rotatable knob type.

The operating unit 510 may have a column shape with an open bottom surface. The operating unit 510 may include an upper surface plate 511 and a side wall 512 extending downward of the storage container 100 along an edge of the upper surface plate 511. The appearance of the operating unit 510 may be defined by the top plate 511 and the side wall 512.

The operating unit 510 may further include a coupling boss 513 rotatably coupled to the interference member 560 and a guide ribs 514 provided along the circumference of the coupling boss 513 to guide the movement of the interference member 560.

The coupling boss 513 may extend downward from the upper surface plate 511 of the operating unit 510 toward the lower side of the storage container 100. The guide rib 514 may be formed to protrude from the top plate 511 along the circumference of the coupling boss 513 so as to be spaced apart from the coupling boss 513. Preferably, the operating unit 510 may include a plurality of ply guide ribs 514. The guide rib 514 may include a guide section 515 provided to be inclined to guide the guide protrusion 562 of the interference member 560.

The first position P1 of the guide section 515 may be closest to the top plate 511. The second position P2 of the guide section 515 may be most spaced apart from the top plate 511. The third position P3 of the guide section 515 may be located between the first position P1 and the second position P2. As the operating unit 510 rotates, the guide protrusion 562 of the interference member 560 may move along the guide section 515 of the guide rib 514. When the guide protrusion 562 of the interference member 560 is located at the first position P1 of the guide section 515, an interference portion 563 of the interference member 560 may be spaced apart from the cam gear 550. When the guide protrusion 562 of the interference member 560 is located at the second position P2 of the guide section 515, the interference portion 563 of the interference member 560 may interfere with the cam gear 550.

The divider cover 520 may be disposed outside the divider body 530 to cover the divider body 530. The divider cover 520 may include a casing accommodating portion 521 provided to accommodate the first casing 571 and the second casing 572. The casing accepter 521 may have a column shape with open upper and lower surfaces. The divider body 530 may extend in the front-rear direction X of the storage container 100. In other words, the divider body 530 may extend in the longitudinal direction of the divider shaft 540. The divider body 530 may further include a second casing 572 provided to accept the interference member 560 therein together with the first casing 571. The second casing 572 may be integrally formed with the divider body 530. The second casing 572 may have a column shape with an open top surface. An elastic member mount 532 may be provided inside the second casing 572. In addition, the second casing 572 may be provided with a shaft seat 533 through which the divider shaft 540 is seated.

The divider shaft 540 may be elongated in the front-rear direction X of the storage container 100. Pinion gears 590 may be coupled to both ends of the divider shaft 540, respectively.

Since the divider 300 moves in the left-right direction Y of the storage container 100 through the interaction between the pinion gears 590 coupled to both ends of the divider shaft 540 and the rack gear 230 of the plurality of guide rails 200, eccentric movement of the divider 300 can be prevented. The divider shaft 540 may be formed with an uneven portion 541 for restraining the cam gear 550.

The divider 500 may further include a cam gear 550 coupled to the divider shaft 540 and rotating integrally with the divider shaft 540, and an interference member 560 provided to selectively interfere with the cam gear 550.

The interference member 560 may be provided to be movable in the vertical direction Z of the storage container 100. That is, the interference member 560 may be provided to be movable in the vertical direction Z of the storage container 100 so as to selectively interfere with the cam gear 550.

The interference member 560 may move in conjunction with the operating unit 510. When the operating unit 510 is rotated, the guide protrusion 562 of the interference member 560 may move along the guide section 515 of the guide rib 514 of the operating unit 510.

Depending on where the guide protrusion 562 is located in the guide section 515, the interference member 560 may move upward of the storage container 100 to be spaced apart from the cam gear 550 or may interfere with the cam gear 550 by moving downward of the storage container 100.

The interference member 560 may include a fastener 561 configured to be coupled with the coupling boss 513 of the operating unit 510, a guide protrusion 562 extending from the fastener 561 in the outer direction of the fastener 561 so as to be located outside the fastener 561, an interference portion 563 having teeth 563*a* engaging with the cam gear 550, and a leg 564 configured to be coupled to the elastic member 580.

The coupling boss 513 of the operating unit 510 may be rotatably coupled to the fastening portion 561 of the interference member 560. The fastener 561 may have a column shape with an open top surface, and the guide protrusion 562 may extend from the fastener 561 to have a predetermined height in the vertical direction Z of the storage container 100. The interference portion 563 may be located under the fastener 561, and the teeth 563*a* may be formed on the lower surface of the interference part 563.

The divider 500 may further include a first casing 571 and a second casing 572 provided to accommodate the interference member 560. The second casing 572 may be integrally formed with the divider body 530, and the first casing 571 may be coupled to an upper portion of the second casing 572. The first casing 571 and the second casing 572 may be accepted in the casing accepter 521 formed in the divider cover 520.

The divider 500 may further include an elastic member 580 disposed between the interference member 560 and the second casing 572 so as to be elastically deformed according to the movement of the interference member 560.

The divider 500 may further include an elastic member 580 disposed between the interference member 560 and the second casing 572 so as to be elastically deformed according to the movement of the interference member 560. One end of the elastic member 580 may be coupled to the leg 564 of the interference member 560, and the other end of the elastic member 580 to be mounted on the elastic member mount 532 of the second casing 572. The elastic member 580 may include a spring capable of contracting and relaxing in the vertical direction Z of the storage container 100.

The divider 500 may further include pinion gears 590 coupled to both ends of the divider shaft 540 to guide the movement of the divider 500 through interaction with the rack gear 230. The pinion gear 590 may rotate integrally with the divider shaft 540.

In the divider 500 according to the third embodiment, since the divider body 530 does not include an arm unlike the divider 300 according to the first embodiment and the divider 500 according to the second embodiment, the divider 500 is guided by an interaction between the pinion gear 590 coupled to both ends of the divider shaft 540 and the rack gear 230 installed on the outer rail 210 of the plurality of guide rails 200.

Figure 17A:
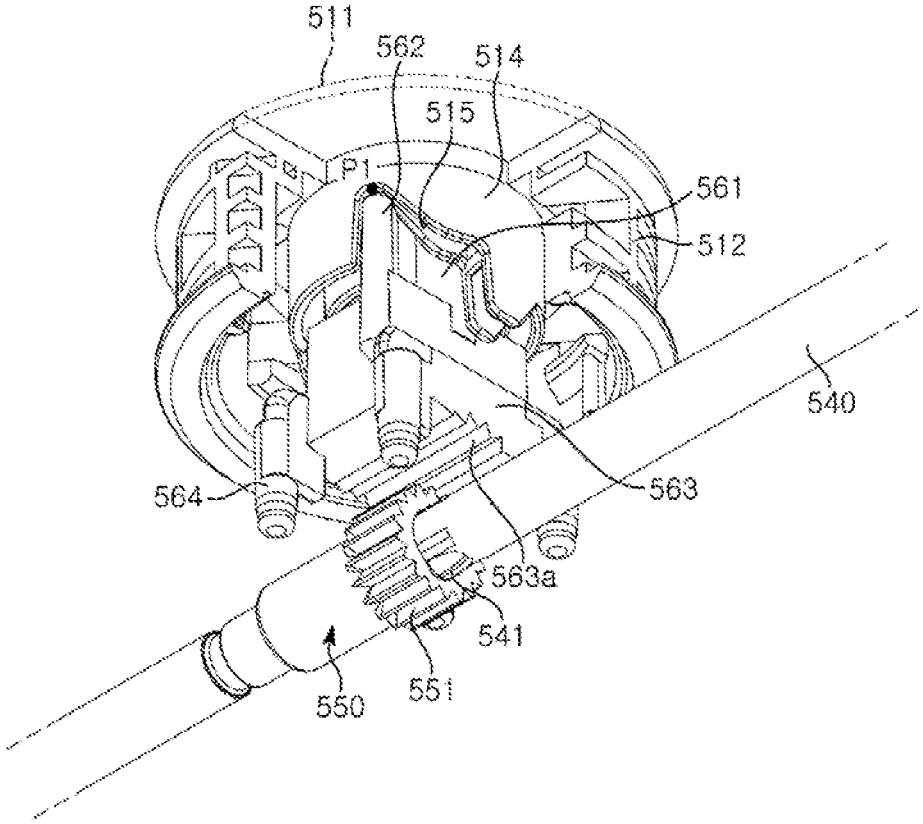
FIGS. 17A to 17C are views illustrating a process of fixing a divider according to a third embodiment in a refrigerator according to an embodiment of the disclosure.
Figure 17B:
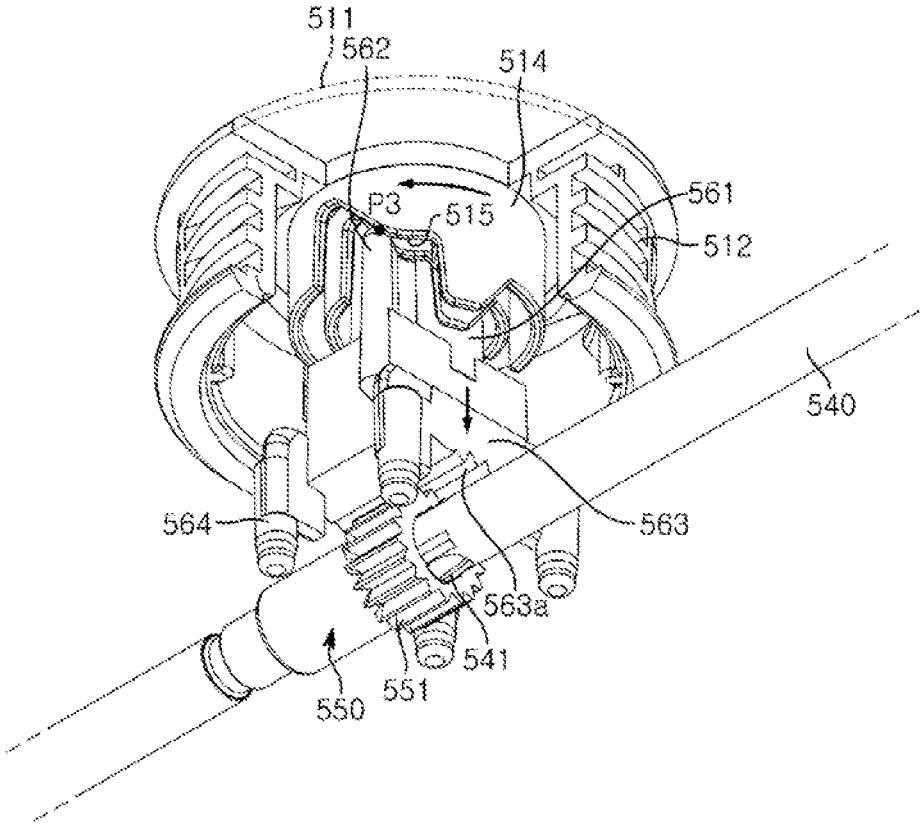
Figure 17C:
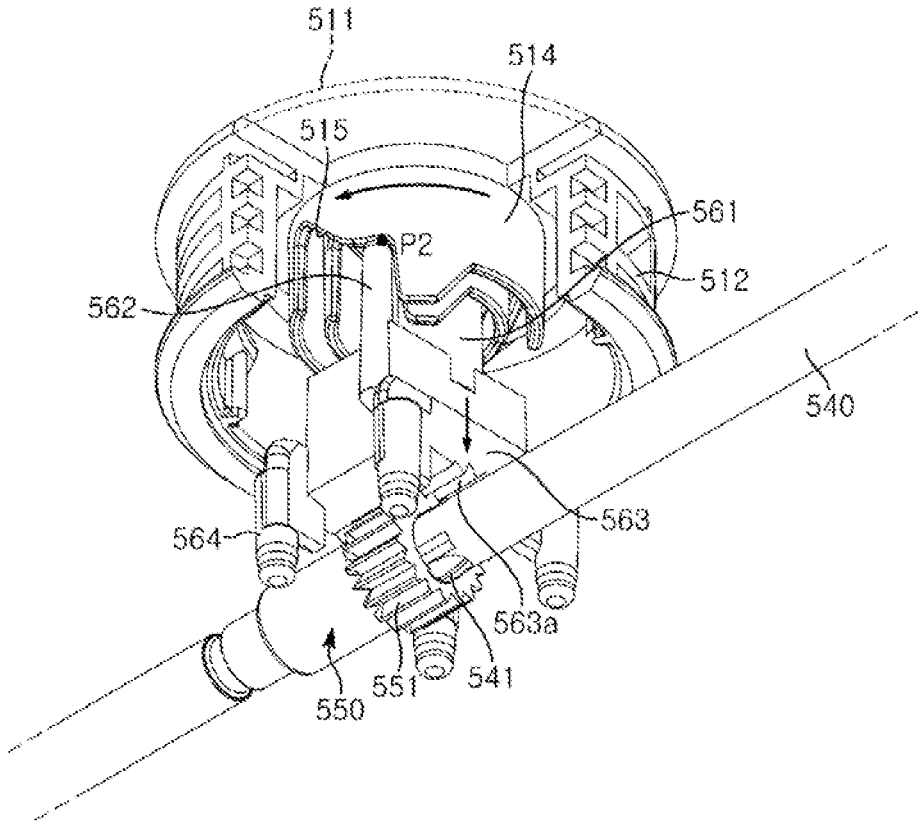

FIGS. 17A to 17C are views illustrating a process of fixing a divider according to a third embodiment in a refrigerator according to an embodiment of the disclosure.

FIG. 17A shows the divider 500 in a movable state. As shown in FIG. 17A, since the guide protrusion 562 of the interference member 560 is positioned at the first position P1 of the guide section 515 of the guide rib 514 of the operating unit 510 when no external force is applied to the operating unit 510, the interference member 560 may be spaced apart from the cam gear 550. Therefore, the divider shaft 540 can rotate freely.

At this time, the pinion gears 590 coupled to both ends of the divider shaft 540 may rotate by engaging with the rack gears 230 of the plurality of guide rails 200, and as a result, the divider 500 may move in the left-right direction Y of the storage container 100 along the plurality of guide rails 200.

17B shows a process in which the interference member 560 moves toward the cam gear 550. As shown in FIG. 17B, When the operating unit 510 is rotated in the first direction, the guide protrusion 562 of the interference member 560 may move along the guide section 515 of the guide rib 514 of the operating unit 510 to be located at the second position P2. At this time, the interference member 560 may move downward of the storage container 100 so as to be adjacent to the cam gear 550.

When the guide protrusion 562 of the interference member 560 is located at the second position P2 of the guide section 515 of the operating unit 510, the interference member 560 and the cam gear 550 are still spaced apart, so the divider shaft 540 can rotate freely.

FIG. 17C shows the divider 500 in a stopped state. As shown in FIG. 17C, when the operating unit 510 is sufficiently rotated in the first direction, The guide protrusion 562 of the interference member 560 may move along the guide section 515 of the guide rib 514 of the operating unit 510 to be located at the third position P3.

At this time, the interference member 560 may interfere with the cam gear 550. When the interference member 560 interferes with the cam gear 550, the teeth 563*a* of the interference member 560 and the teeth 551 of the cam gear 550 can engage with each other, and the rotation of the cam gear 550 is limited, so the rotation of the divider shaft 540 is also limited.

The divider 300 according to the first embodiment, the divider 400 according to the second embodiment, and the divider 500 according to the third embodiment described above may be applied not only to a storage container provided in a refrigerator, but also to a storage container of various products.

Although the air conditioner has been described by way of embodiments in relation to a specific shape and direction, the above embodiments are illustrative purpose only, and it would be appreciated by those skilled in the art that changes and modifications may be made in these embodiments without departing from the principles and scope of the disclosure, the scope of which is defined in the claims and their equivalents.

What is claimed is:

1. A refrigerator comprising:

a main body;

a storage chamber provided inside the main body and having an open front surface;

a door provided to open and close the open front surface of the storage chamber; and a storage container having a storage space and provided to be withdrawn in the storage chamber wherein the storage container includes:

a plurality of guide rails installed to face each other on an inner wall of the storage container; and a divider provided to be movable along the plurality of guide rails to divide the storage space into a plurality of storage spaces, wherein the divider includes:

an operating unit;

a divider shaft having both ends movable along the plurality of guide rails;

a cam gear coupled to the divider shaft and rotating together with the divider shaft; and an interference member configured to move in conjunction with the operating unit to selectively interfere with the cam gear.

2. The refrigerator of claim 1, wherein the interference member is coupled to the divider shaft to be movable according to the operation of the operating unit.

3. The refrigerator of claim 1, wherein the interference member includes teeth provided to engage with the cam gear.

4. The refrigerator of claim 1, wherein the divider further includes a divider body extending in a longitudinal direction of the divider shaft and having an arm movably coupled to the plurality of guide rails.

5. The refrigerator of claim 4, wherein the operating unit is coupled to the divider body to move in the vertical direction of the storage container.

6. The refrigerator of claim 5, wherein the operating unit includes:

a pressing portion provided to be exposed to the outside; and a push portion configured to extend from the pressing portion toward a lower side of the storage container and push the interference member to interfere with the cam gear when the operating unit is pressed toward the lower side of the storage container.

7. The refrigerator of claim 5, wherein the divider further includes an elastic member configured to move the interference member away from the cam gear when the operating unit moves upward of the storage container, and wherein the elastic member is disposed between the divider body and the interference member.

8. The refrigerator of claim 5, wherein the divider further includes a latch fixedly coupled to the divider body, and wherein the operating unit includes: a pressing portion provided to be exposed to the outside; and a protrusion formed to protrude from the pressing portion to be coupled to the latch.

9. The refrigerator of claim 5, wherein the operating unit includes:

a pressing portion provided to be exposed to the outside;

an extension portion formed to extend from the pressing portion toward a lower side of the storage container, and an elastic body disposed between the extension portion and the divider body to be elastically deformable according to the movement of the operating unit.

10. The refrigerator of claim 1, wherein the plurality of guide rails includes a rack gear, and wherein the divider further includes pinion gears coupled to both ends of the divider shaft to guide the movement of the divider through interaction with the rack gear.

11. The refrigerator of claim 4, wherein the operating unit is provided to be slidable in the longitudinal direction of the divider shaft.

12. The refrigerator of claim 11, wherein one end of the interference member is coupled to the divider shaft, and an other end of the interference member is coupled to the operating unit.

13. The refrigerator of claim 11, wherein the divider further includes a divider cover disposed outside the divider body to cover the divider body and having an incision cut in the longitudinal direction of the divider shaft.

14. The refrigerator of claim 13, wherein the operating unit includes:

an operating unit casing slidably coupled to the divider body, and a plurality of protrusions configured to move integrally with the operating unit casing by being constrained by the incision.

15. The refrigerator of claim 14, wherein the operating unit further includes an elastic body installed on the divider body to be positioned between the plurality of protrusions adjacent to each other, and provided to be convexly bent in the same direction as the sliding direction of the operating unit by interaction with the plurality of protrusions.

* * * * *